US008244155B2

(12) United States Patent
Kouda

(10) Patent No.: US 8,244,155 B2
(45) Date of Patent: Aug. 14, 2012

(54) DEVELOPER CARTRIDGE WITH SHUTTER MEMBER AND IMAGE FORMING APPARATUS

(75) Inventor: Syouji Kouda, Osaka (JP)

(73) Assignee: Kyocera Mita Corporation (JP)

( * ) Notice: Subject to any disclaimer, the term of this patent is extended or adjusted under 35 U.S.C. 154(b) by 239 days.

(21) Appl. No.: 12/819,810

(22) Filed: Jun. 21, 2010

(65) Prior Publication Data

US 2010/0329747 A1 Dec. 30, 2010

(30) Foreign Application Priority Data

Jun. 30, 2009 (JP) ..... 2009-155281

(51) Int. Cl.
*G03G 15/08* (2006.01)

(52) U.S. Cl. ..... 399/119; 399/262; 399/263

(58) Field of Classification Search ..... 399/262, 399/110, 120, 119, 263
See application file for complete search history.

(56) References Cited

U.S. PATENT DOCUMENTS

| | | | | |
|---|---|---|---|---|
| 6,259,874 | B1 * | 7/2001 | Murakami et al. | 399/120 |
| 7,006,779 | B2 | 2/2006 | Otani | |
| 7,209,680 | B2 * | 4/2007 | Kweon | 399/111 |
| 7,248,824 | B2 * | 7/2007 | Takami | 399/258 |
| 8,190,070 | B2 * | 5/2012 | Maeshima et al. | 399/262 |
| 2004/0009006 | A1 * | 1/2004 | Yamada et al. | 399/106 |
| 2004/0223790 | A1 * | 11/2004 | Hosokawa et al. | 399/258 |
| 2008/0075506 | A1 * | 3/2008 | Sato | 399/262 |
| 2008/0170890 | A1 * | 7/2008 | Nishimura et al. | 399/263 |
| 2009/0185824 | A1 * | 7/2009 | Murakami et al. | 399/120 |
| 2011/0052266 | A1 * | 3/2011 | Yoon et al. | 399/258 |

FOREIGN PATENT DOCUMENTS

| | | |
|---|---|---|
| JP | 2005-17478 | 1/2005 |
| JP | 2008-116479 | 5/2008 |

* cited by examiner

*Primary Examiner* — David Gray
*Assistant Examiner* — Tyler Hardman
(74) *Attorney, Agent, or Firm* — Gerald E. Hespos; Michael J. Porco

(57) ABSTRACT

A developer cartridge is provided with a cartridge main body with a supply port for supplying developer to an apparatus main body of an image forming apparatus, a shutter member displaceable between an opening position for opening the supply port and a closing position for closing the supply port, an operation lever arranged to face the opening cover and adapted to displace the shutter member between the opening position and the closing position, and a biasing member for biasing the operation lever toward the closing posture. The operation lever is displaceable between an opening posture corresponding to the opening position and a closing posture corresponding to the closing position. The operation lever is displaced from the closing posture to the opening posture against a biasing force of the biasing member due to interference with a part of the opening cover when the opening cover is closed.

12 Claims, 10 Drawing Sheets

-X
+X
20
40
30
37
371
372
381(38)
381a
332
30(20)
190
52
521
522
53
531
532
532a
532b
533
533a
527
621
621a
622
62
382

DEVELOPER CARTRIDGE WITH SHUTTER MEMBER AND IMAGE FORMING APPARATUS

BACKGROUND OF THE INVENTION

1. Field of the Invention

The present invention relates to a developer cartridge to be detachably mounted into an apparatus main body of an image forming apparatus and an image forming apparatus with the developer cartridge.

2. Description of the Related Art

A developer cartridge is for supplying developer to a developing device housed in an apparatus main body of an image forming apparatus. The developer cartridge filled with the developer is detachably mounted into the apparatus main body with a door disposed at a specified position of the apparatus main body opened. The mounted developer cartridge is replaced with a new one when being emptied due to the consumption of the developer by image forming processes and then the opened door is closed.

A known developer cartridge is formed at the bottom of a cartridge main body with a supply port for supplying developer, and a shutter member for opening and closing the supply port is provided in the cartridge main body. Further, an operation lever for opening and closing operations of the shutter member is provided outside the cartridge main body.

When such a developer cartridge is mounted into the apparatus main body of the image forming apparatus, the operation lever is operated to supply the developer to the developing device. By this operation, the shutter member is opened and the developer in the cartridge main body can be supplied to the developing device through the supply port.

However, with the conventional developer cartridge, the supply port cannot be opened by moving the shutter member in a closed state unless a user manually operates the operation lever after the developer cartridge is mounted into the apparatus main body of the image forming apparatus. Accordingly, as in the case where the user forgot to operate the operation lever at the time of mounting the developer cartridge into the apparatus main body, there may occur such an inconvenience that the door is closed with the shutter member left closing the supply port and the image forming process is performed in this state.

In order to solve such an inconvenience, a developer cartridge according to a first prior art includes a sensor for detecting an opened/closed state of a supply port and the detection result of this sensor is output. In this case, a user can check whether or not an operation lever has been operated by seeing the detection result.

On the contrary, a developer cartridge according to a second prior art is so constructed that a specified interference member interferes with a door and the door cannot be closed unless an operation lever is operated. This enables a user to learn that the operation lever has not been operated.

However, for the developer cartridge according to the first prior art, it is necessary to additionally provide the sensor for detecting the operation of the operation lever and a notifier for notifying the detection result of the sensor, which presents a problem of increasing the number of parts and the cost of the apparatus. With the developer cartridge according to the second prior art, it can be learned that the operation of the operation lever was forgotten if the door cannot be closed. However, after learning that, the user has to open the door and operate the operation lever. Thus, it is very cumbersome for the user.

SUMMARY OF THE INVENTION

An object of the present invention is to enable an operation lever to be reliably operated to supply developer while suppressing an increase in the cost of an apparatus.

In order to accomplish this object, one aspect of the present invention is directed to a developer cartridge to be detachably mounted into an apparatus main body of an image forming apparatus with an opening door of the apparatus main body opened and adapted to supply developer to the apparatus main body, including a cartridge main body with a supply port for supplying the developer to the apparatus main body; a shutter member displaceable between an opening position for opening the supply port and a closing position for closing the supply port; an operation lever for displacing the shutter member between the opening position and the closing position, the operation lever being displaceable between an opening posture corresponding to the opening position and a closing posture corresponding to the closing position; and a biasing member for biasing the operation lever toward the closing posture, the operation lever being displaced from the closing posture to the opening posture against a biasing force of the biasing member due to interference with a part of the opening cover when the opening cover is closed.

Another aspect of the present invention is directed to an image forming apparatus, including an apparatus main body with an opening cover; an image bearing member accommodated in the apparatus main body and adapted to bear a developer image; and a developer cartridge to be detachably mounted into the apparatus main body with the opening cover opened and adapted to supply the developer, wherein the developer cartridge has the above construction.

Other objects of the present invention and specific advantages obtained by the present invention will become more apparent upon reading the following description of an embodiment.

BRIEF DESCRIPTION OF THE DRAWINGS

FIGS. 9A to 9D are diagrams showing the function of a rotation mechanism, wherein FIGS. 9A and 9B show states of the rotation mechanism and a shutter member when a lever plate is set in an inclined posture and FIGS. 9C and 9D show states of the rotation mechanism and the shutter member when the lever plate is set in a laid posture.

FIGS. 10A and 10B are side views partly in section showing the function of a pressing member, wherein FIG. 10A shows a state immediately before the maintenance door is closed and FIG. 10B shows a state where the maintenance door is closed.

DETAILED DESCRIPTION OF THE PREFERRED EMBODIMENTS

Figure 1:
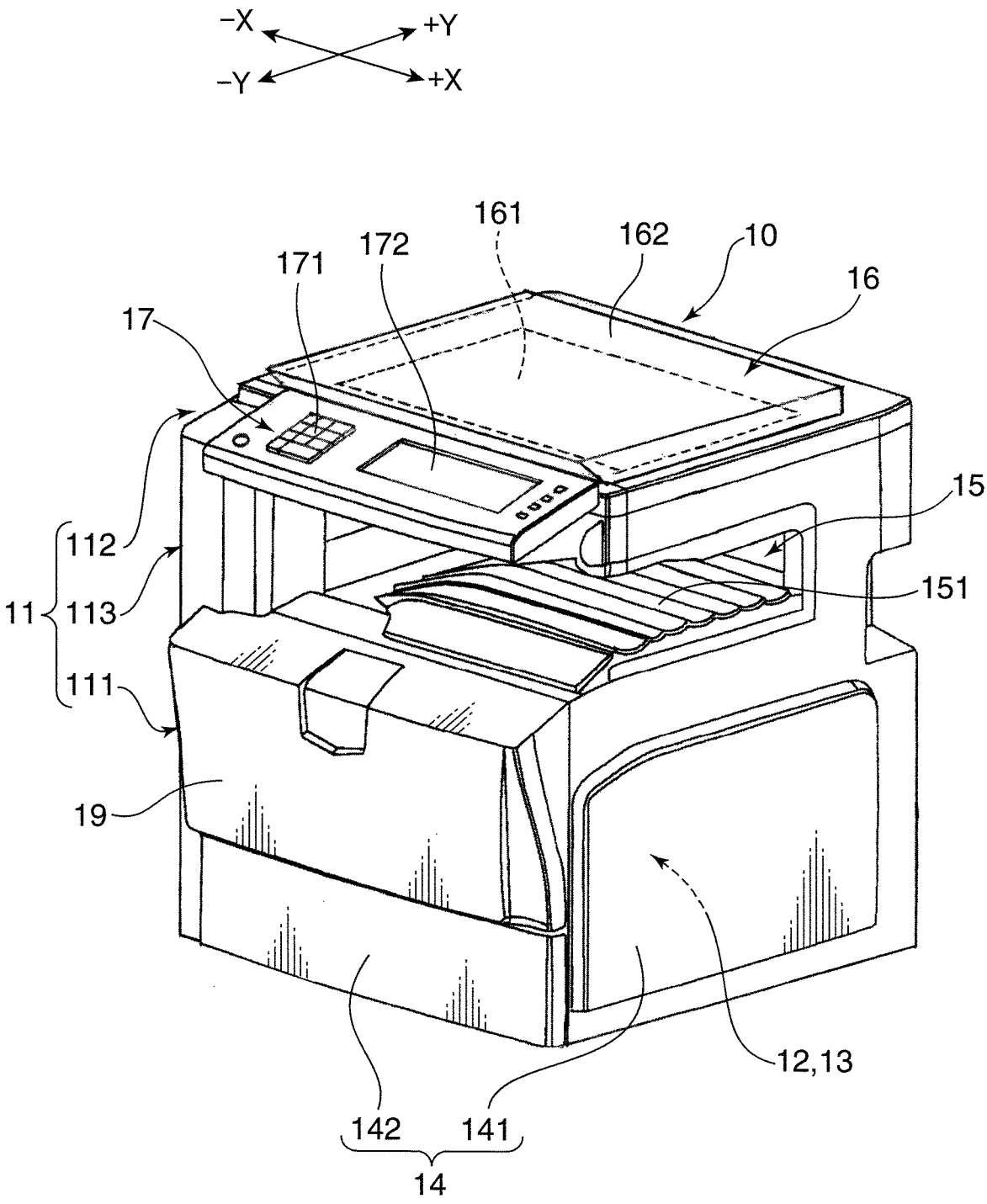
FIG. 1 is an external perspective view of an image forming apparatus employing a toner (developer) cartridge according to one embodiment of the invention showing a state where a maintenance door is closed.
Figure 2:
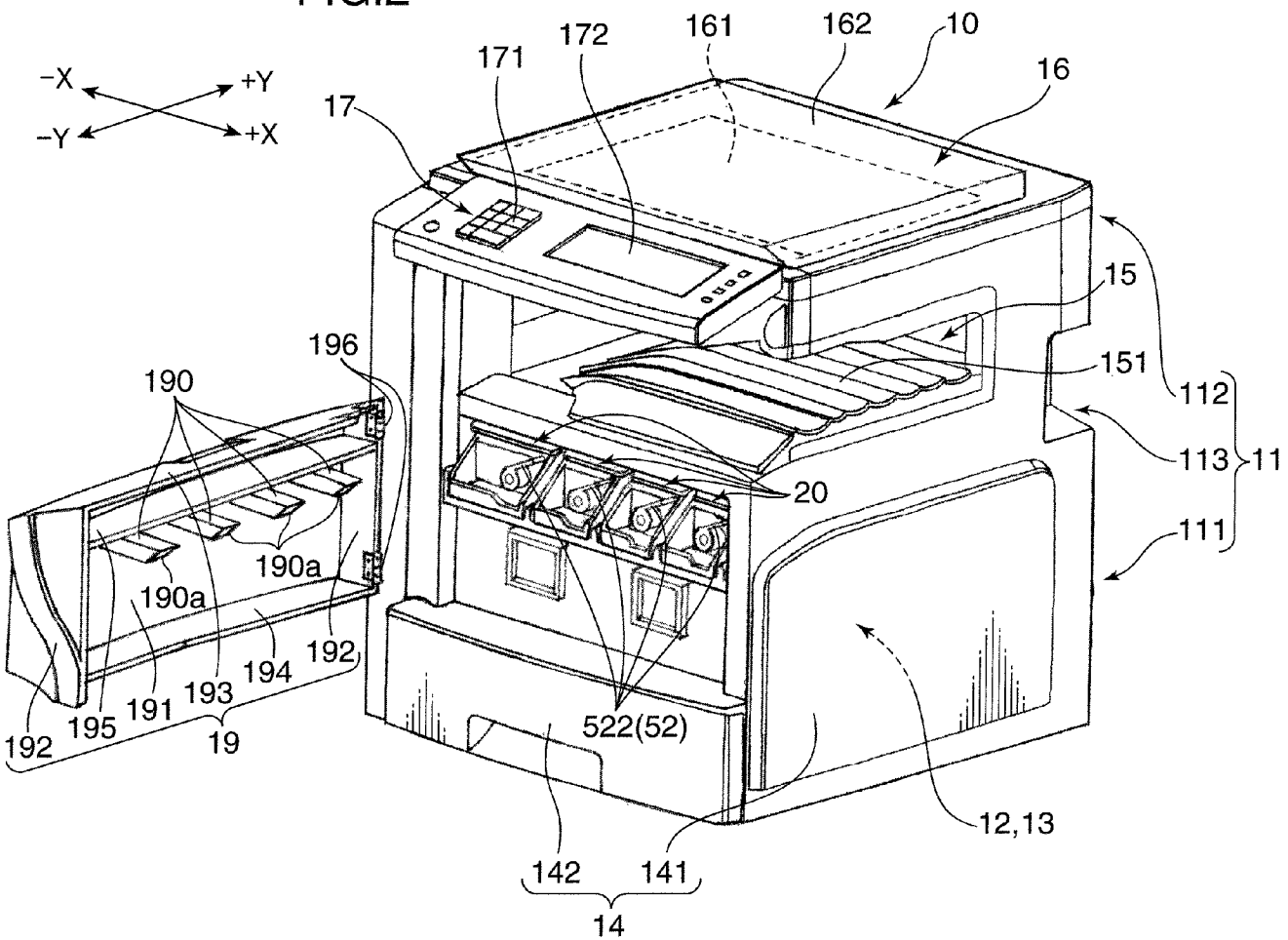
FIG. 2 is a perspective view showing a state where the maintenance door shown in FIG. 1 is opened.
Figure 3:
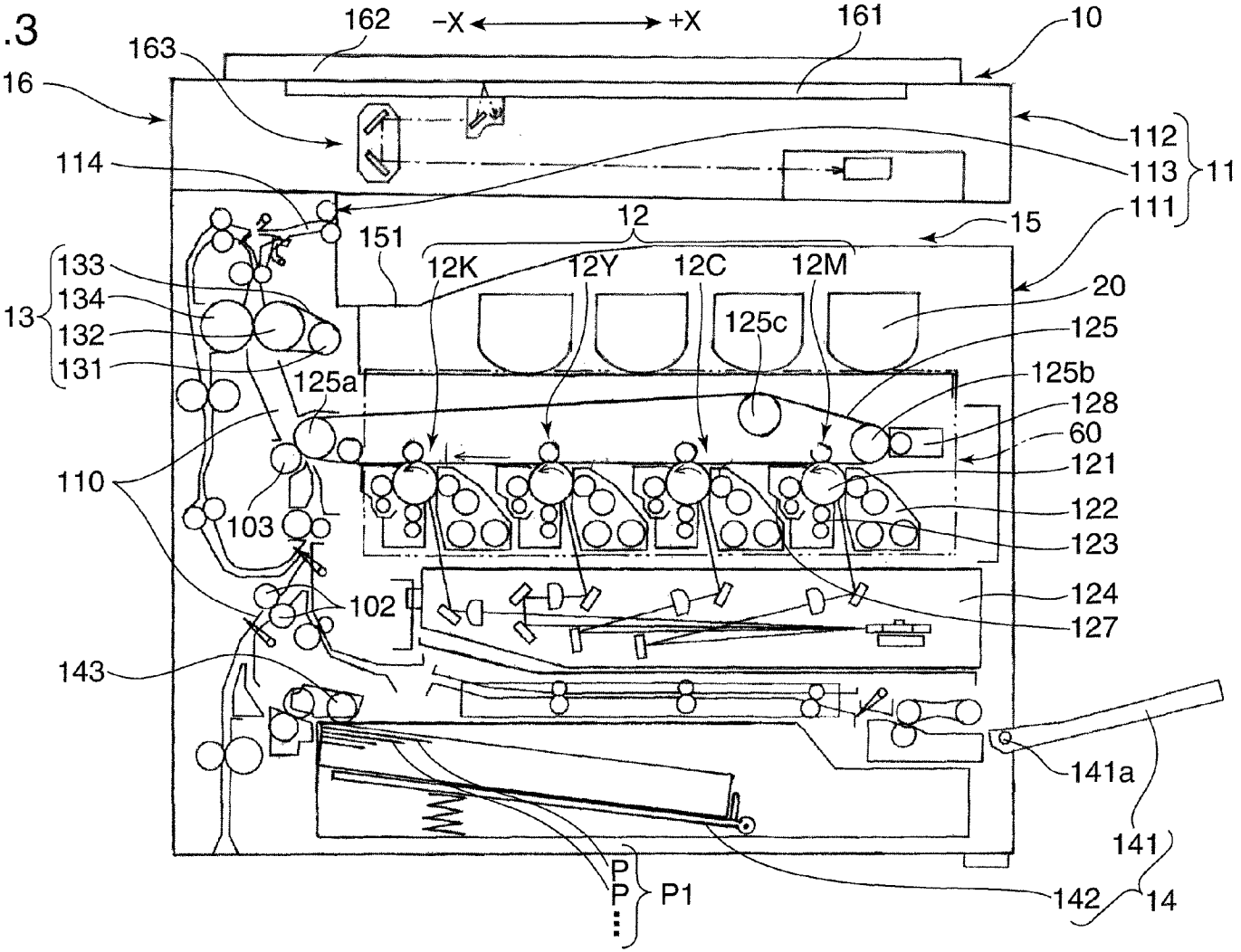
FIG. 3 is a front sectional view schematically showing the internal structure of the image forming apparatus.

Hereinafter, one embodiment of the present invention is described in detail with reference to the accompanying drawings. FIGS. 1 and 2 are external perspective views showing an image forming apparatus 10 employing a toner cartridge according to one embodiment of the present invention, wherein FIG. 1 shows a state where a maintenance door 19 is closed and FIG. 2 shows a state where the maintenance door 19 is opened. FIG. 3 is a front sectional view schematically showing the internal structure of the image forming apparatus 10. In FIGS. 1 to 3, X directions are lateral directions and Y directions are forward and backward directions, particularly −X direction is leftward direction, +X direction is rightward direction, −Y direction is forward direction and +Y direction is backward direction.

The image forming apparatus 10 is a copier of the so-called internal discharge type and includes an image forming station 12, a fixing unit 13, a sheet storage unit 14, a sheet discharge unit 15, an image reading unit 16 and an operation unit 17 arranged in an apparatus main body 11. The sheet discharge unit 15 is formed by denting a part of the apparatus main body 11 below the image reading unit 16 and, hence, this image forming apparatus 10 is called to be of the internal discharge type.

The apparatus main body 11 includes a lower main body 111 having a rectangular parallelepipedic outer shape, an upper main body 112 having a flat rectangular parallelepipedic outer shape arranged to face the lower main body 111 from above, and a connecting part 113 disposed between these upper main body 112 and lower main body 111. The connecting part 113 is a structure for connecting the lower and upper main bodies 111, 112 with each other with the sheet discharge unit 15 for internal discharge formed between the lower and upper main bodies 111, 112 and stands from left and rear parts of the lower main body 111 to be L-shaped when viewed from above. The upper main body 112 has left and rear parts thereof supported on the upper end of the connecting part 113.

The image forming station 12, the fixing unit 13 and the sheet storing unit 14 are housed in the lower main body 111, and the image reading unit 16 is mounted in the upper main body 112. The operation unit 17 projects forward from a front edge part of the upper main body 112.

The sheet storing unit 14 includes a manual feed tray 141 openably and closably provided on the right wall of the apparatus main body 11 and a sheet tray 142 detachably insertable at a position below an exposure device 124 in the apparatus main body 11. A sheet stack P1, in which a plurality of sheets P are stacked, is stored in the sheet tray 142. Although one sheet tray 142 is provided in one level in this embodiment, two or more may be provided in different levels.

The manual feed tray 141 has its bottom part supported rotatably about a supporting shaft 141*a* (FIG. 3) and is displaceable between a closing posture (FIG. 1) in which it stands to close a manual feed port and an opening posture (FIG. 3) in which it projects rightward. With the manual feed tray 141 set in the opening posture, sheets P are manually fed one by one.

The sheet discharge unit 15 is formed between the lower and upper main bodies 111 and 112 and includes a discharge tray 151 formed on the upper surface of the lower main body 111. A sheet P having a toner image transferred thereto in the image forming station 12 is discharged toward the discharge tray 151 from a lower part of the connecting part 113 after a fixing process is performed thereto in the fixing unit 13.

The image reading unit 16 includes a contact glass 161 mounted in an upper opening of the upper main body 112 and used to place a document, an openable and closable document pressing cover 162 for pressing the document placed on the contact glass 161 and a scanning mechanism 163 (FIG. 3) for scanning an image of the document placed on the contact glass 161. Analog information of the document image optically read by the scanning mechanism 163 is output to the exposure device 124 to be described later for an image forming process in the image forming station 12 after being converted into a digital signal.

The operation unit 17 is used to input process information relating to the image forming process and includes a numerical pad 171 and other various operation keys used to input the number of sheets P to be processed, and an LCD (Liquid Crystal Display) 172 used for touch input.

The openable and closable maintenance door (opening door) 19 is provided on the front surface of the lower main body 111. This maintenance door 19 is opened as shown in FIG. 2 especially when a toner cartridge (developer cartridge) 20 to be described later is to be replaced with a new one or a sheet P jammed while being conveyed is to be removed (i.e. when a jam occurs).

The maintenance door 19 has a flat rectangular parallelepipedic shape with an open surface at a side corresponding to the image forming station 12 and includes a front door plate 191, a pair of side plates 192 extending toward the image forming station 12 from the opposite lateral edges of the front door plate 191, an upper plate 193 extending toward the image forming station 12 along the upper edges of the side plates 192 from the upper edge of the front door plate 191, a lower plate 194 extending toward the image forming station 12 along the lower edges of the side plates 192 from the lower edge of the front door plate 191, and a rib plate 195 mounted between the pair of side plates 192.

In such a maintenance door 19, a pair of upper and lower hinges 196 are disposed between the left side plate 192 in FIG. 1 and the left column of the lower main body 111 of the apparatus main body 11 as shown in FIG. 2. In this way, the maintenance door 19 can be rotated in forward and reverse directions about the hinges 196 to be opened and closed relative to the apparatus main body 11.

The maintenance door 19 also includes a plurality of (four in this embodiment) pressing rods (pressing members: parts of the maintenance door) 190 projecting from the rib plate 195 toward the toner cartridges 20 and adapted to press lever plates 522 of a plurality of operation levers 52 to be described later. By closing the maintenance door 19 so that these pressing rods 190 press the lever plates 522 downward, the operation levers 52 set in closing postures are displaced to opening postures. This is described in detail later.

The maintenance door 19 includes an unillustrated locking member for locking the maintenance door 19 in the closed state. Thus, the maintenance door 19 cannot be opened by being locked by the locking member once being closed. In order to open the closed maintenance door 19, a user operates an unillustrated unlocking lever provided in the locking member.

The internal structure of the image forming apparatus 10 is outlined with reference to FIG. 3. The image forming station 12 is for forming a toner image on a sheet P fed from the sheet storage unit 14. In this embodiment, the image forming station 12 includes a magenta image forming unit 12M using magenta developer, a cyan image forming unit 12C using cyan developer, a yellow image forming unit 12Y using yellow developer and a black image forming unit 12K using black developer which are successively arranged from an upstream side (right side in the plane of FIG. 3) to a downstream side.

Each of the image forming units 12M, 12C, 12Y and 12K includes a photoconductive drum 121 and a developing device 122 for supplying toner to the photoconductive drum 121. Each photoconductive drum 121 is for forming an electrostatic latent image on its circumferential surface and a toner image (visible image) in conformity with the electrostatic latent image.

Each photoconductive drum 121 receives the supply of the toner from the corresponding developing device 122 while being rotated in a counterclockwise direction in FIG. 3, whereby a toner image in conformity with an electrostatic latent image is formed on the circumferential surface. The developer is supplied to each developing device 122 via an unillustrated developer supply duct from the corresponding toner cartridge 20 detachably mounted in a space between the discharge tray 151 and an intermediate transfer belt 125 to be described later.

Chargers 123 are arranged right below the respective photoconductive drums 121 and the exposure device 124 is arranged below the respective chargers 123. Each photoconductive drum 121 has the circumferential surface uniformly charged by the corresponding charger 123. The exposure device 124 irradiates the charged circumferential surfaces of the photoconductive drums 121 with laser beams corresponding to the respective colors and based on image data input from a computer or the like. In this way, electrostatic latent images are formed on the circumferential surfaces of the respective photoconductive drums 121. The developing devices 122 supply the toners to the electrostatic latent images to form toner images on the circumferential surfaces of the respective photoconductive drums 121.

The intermediate transfer belt 125 is arranged above the respective photoconductive drums 121. The intermediate transfer belt 125 is mounted between a drive roller 125*a* on the left side of FIG. 3 and a driven roller 125*b* on the right side and the lower surface thereof (part moving to the left in FIG. 1) is in contact with the circumferential surfaces of the respective photoconductive drums 121. An image bearing surface is set on the outer circumferential surface of the intermediate transfer belt 125 and pressed against the circumferential surfaces of the photoconductive drums 121 by transfer rollers disposed in correspondence with the respective photoconductive drums 121. In this state, the intermediate transfer belt 125 is rotated between the drive roller 125*a* and the driven roller 125*b* while being synchronized with the respective photoconductive drums 121.

In this embodiment, a tension roller 125*c* is disposed at a position between the drive roller 125*a* and the driven roller 125*b* and closer to the driven roller 125*b*. The tension roller 125*c* is for giving a tensile force to the intermediate transfer belt 125 and biased upward by a biasing force of an unillustrated biasing member. Thus, an upward facing part (belt part moving to the right in FIG. 3) of the intermediate transfer belt 125 is pushed upward by this tension roller 125*c*. In this way, the intermediate transfer belt 125 has a mountain shape peaked at its part corresponding to the tension roller 125*c*.

By the rotation of the intermediate transfer belt 125, a toner image of the magenta developer is first transferred to the image bearing surface by the photoconductive drum 121 of the magenta image forming unit 12M. Subsequently, by the photoconductive drum 121 of the cyan image forming unit 12C, a toner image of the cyan developer is transferred in a superimposition manner at the same position of the image bearing surface where the magenta toner image is transferred. Thereafter, a toner image of the yellow developer and a toner image of the black developer are successively transferred in a superimposition manner at the same position by the photoconductive drum 121 of the yellow image forming unit 12Y and the photoconductive drum 121 of the black image forming unit 12K. In this way, a color toner image is formed on the outer surface of the intermediate transfer belt 125. The color toner image on this intermediate transfer belt 125 will be transferred to a sheet P conveyed from the sheet storage unit 14.

A drum cleaner 127 for cleaning the circumferential surface of the photoconductive drum 121 by removing the residual toner on the circumferential surface of the photoconductive drum 121 is arranged to the left of each photoconductive drum 121 in FIG. 3. The circumferential surface of the photoconductive drum 121 cleaned by the drum cleaner 127 heads for the charger 123 for a new charging process. The waste toner removed from the circumferential surface of the photoconductive drum 121 by the drum cleaner 127 is collected into a collection container in the toner junction/storage device 60 (chain double-dashed line in FIG. 3, FIG. 8A) via a specified path.

A vertically extending sheet conveyance path 110 is formed to the left of the image forming station 12 in FIG. 3. Conveyor roller pairs 102 are disposed at specified positions in this sheet conveyance path 110. A sheet P from the sheet storage unit 14 is conveyed toward the intermediate transfer belt 125 mounted on the drive roller 125*a* by driving the conveyor roller pairs 102.

A secondary transfer roller 103 held in contact with the outer surface of the intermediate transfer belt 125 is disposed at a position facing the drive roller 125*a* in the sheet conveyance path 110. A sheet P being conveyed in the sheet conveyance path 110 is pressed and held between the intermediate transfer belt 125 and the secondary transfer roller 103, whereby a toner image on the intermediate transfer belt 125 is transferred to this sheet P.

The fixing unit 13 is for fixing a toner image on a sheet P transferred in the image forming station 12. The fixing unit 13 includes a heating roller 131 internally provided with a heating element as a heat source, a fixing roller 132 arranged at the left side in FIG. 3 and facing the heating roller 131, a fixing belt 133 mounted between the fixing roller 132 and the heating roller 131 and a pressure roller 134 arranged to face the fixing roller 132 via the fixing belt 133.

A fixing process is performed to the sheet P, which was fed to the fixing unit 13 after having the toner image on the intermediate transfer belt 125 transferred thereto, by heat from the fixing belt 133 while the sheet P is passing between the pressure roller 134 and the hot fixing belt 133. The color printed sheet P finished with the fixing process is discharged toward the discharge tray 151 provided on the top of the apparatus main body 11 through a discharge conveyance path 114 extending from a position above the fixing unit 13.

The sheet storage unit 14 includes the manual feed tray 141 and the sheet tray 142 as described above. The sheet tray 142 includes a box body with an entirely open upper surface and the sheet stack P1, in which a plurality of sheets P are stacked, is stored therein. The uppermost sheet P of the sheet stack P1 stored in the sheet tray 142 has the upper surface of its downstream end (left end in FIG. 3) held in contact with a pickup roller 143 and is dispensed toward the sheet conveyance path 110 by driving the pickup roller 143. The sheets P dispensed one by one from the sheet tray 142 are fed to a nip between the secondary transfer roller 103 and the intermediate transfer belt 125 in the image forming station 12 via the sheet conveyance path 110 by driving the conveyor roller pairs 102.

In this embodiment, a belt cleaner 128 is arranged at a position corresponding to the driven roller 125*b*. The belt cleaner 128 cleans the intermediate transfer belt 125 by removing the residual toner remaining on the intermediate transfer belt 125 after the second transfer. Note that the second transfer is a process of transferring a color image on the outer surface of the lower part of the intermediate transfer belt 125 to a sheet P in the nip between the intermediate transfer belt 125 and the secondary transfer roller 103 at the position of the drive roller 125*a*.

The toner junction/storage device 60 is arranged before the respective constituent elements of the image forming station 12 such as the photoconductive drums 121 and the intermediate transfer belt 125 in the lower main body 111. The toner junction/storage device 60 supplies the developers from the respective toner cartridges 20 to the corresponding developing devices 122 arranged below the intermediate transfer belt 125. The toner junction/storage device 60 has a function of storing the waste toners collected from a plurality of drum cleaners 127 arranged in correspondence with the respective photoconductive drums 121 and one belt cleaner 128 arranged in correspondence with the intermediate transfer belt 125.

Figure 8A:
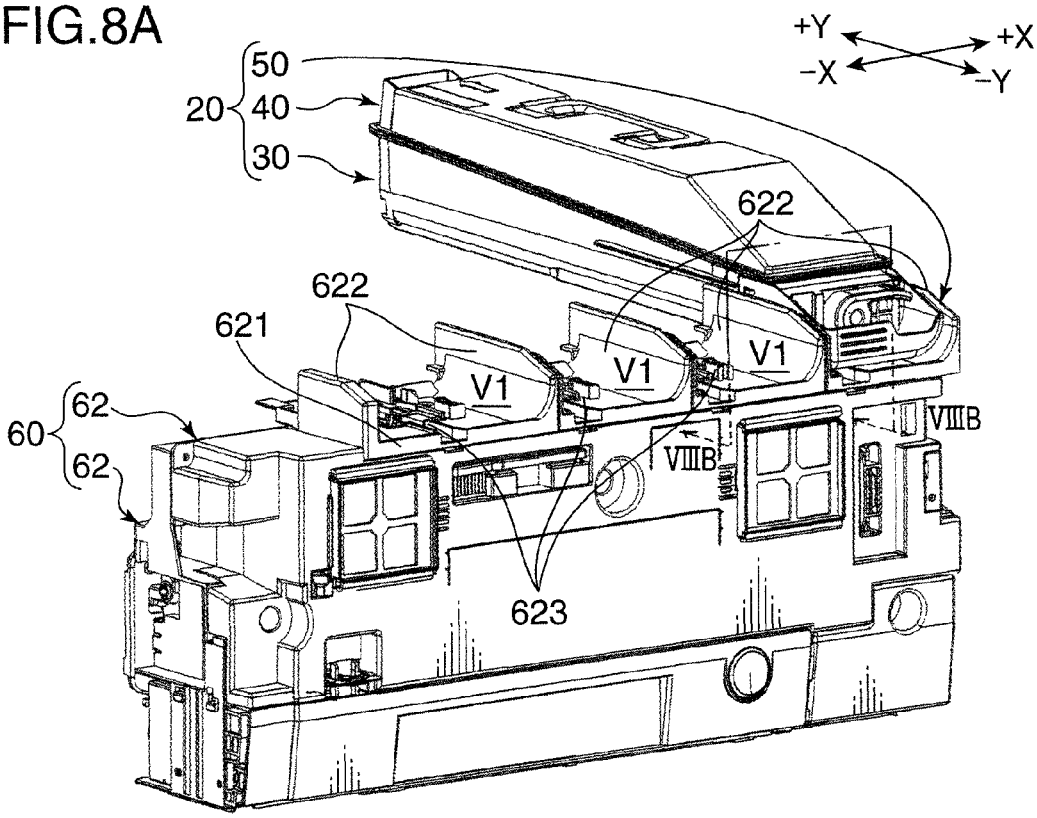
FIG. 8A is a perspective view showing a state where the toner cartridge is supported on a toner junction/storage device.

The respective toner cartridges 20 mounted in the lower main body 111 have their front end parts supported on the upper surface of this toner junction/storage device 60 (see FIG. 8A). The toner cartridges 20 supported on the toner junction/storage device 60 are locked in their supported state by operating the operation levers 52 to be described later from the inclined postures to the laid postures to set shutter tubes 381 at opening positions (see FIG. 9C).

Figure 4:
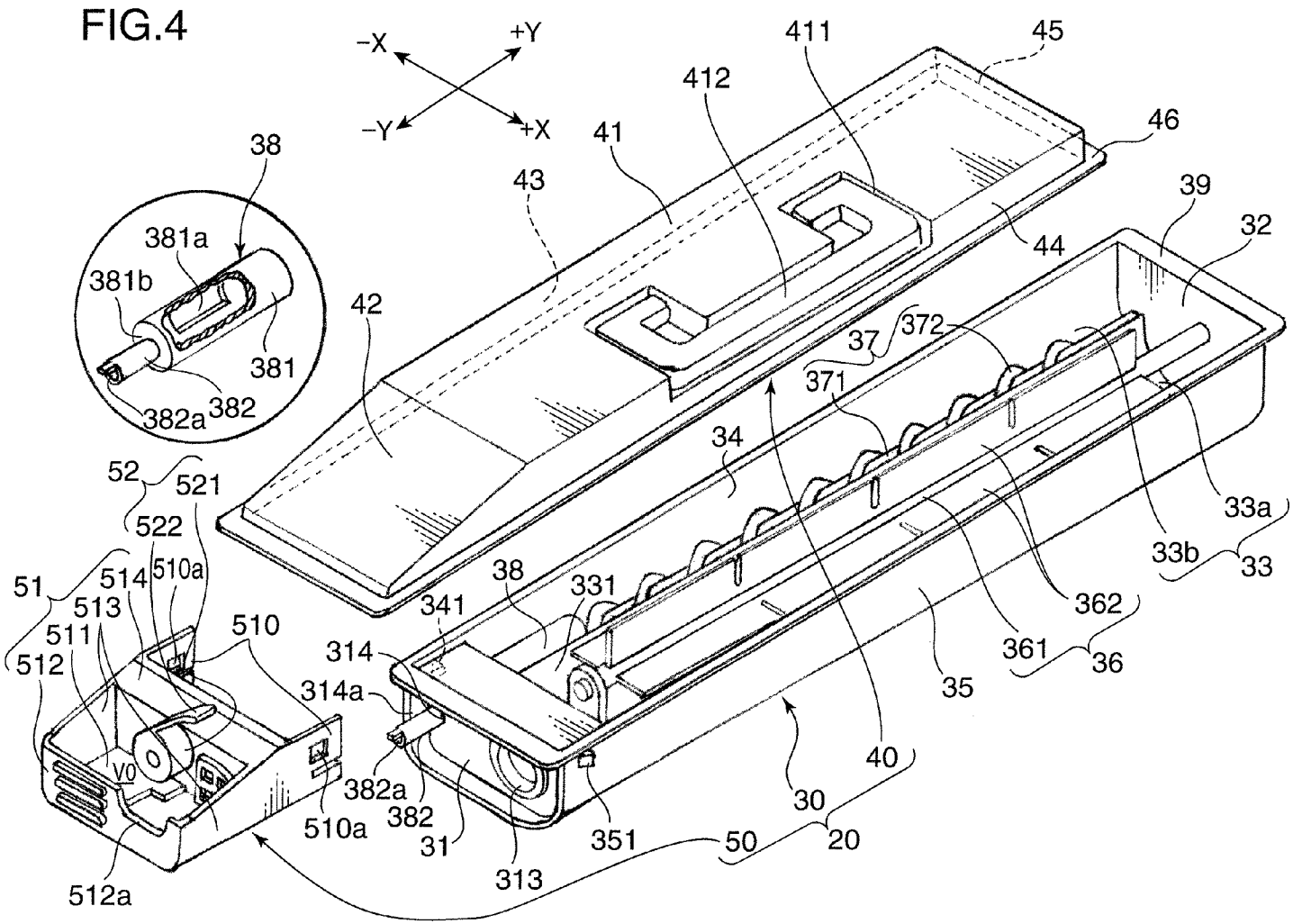
FIG. 4 is an exploded perspective view showing one embodiment of the toner cartridge.
Figure 5:
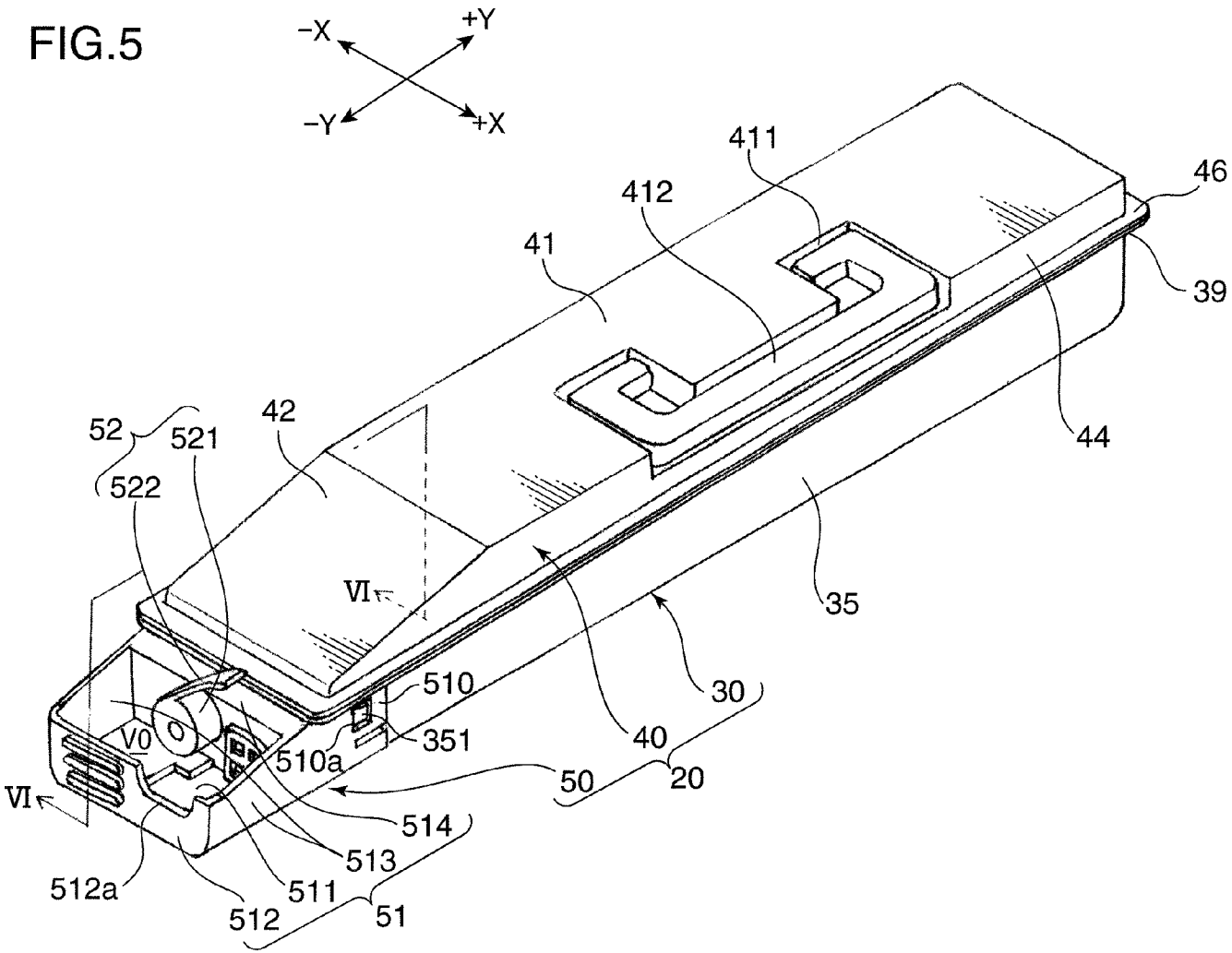
FIG. 5 is a perspective view after the toner cartridge shown in FIG. 4 is assembled.
Figure 6:
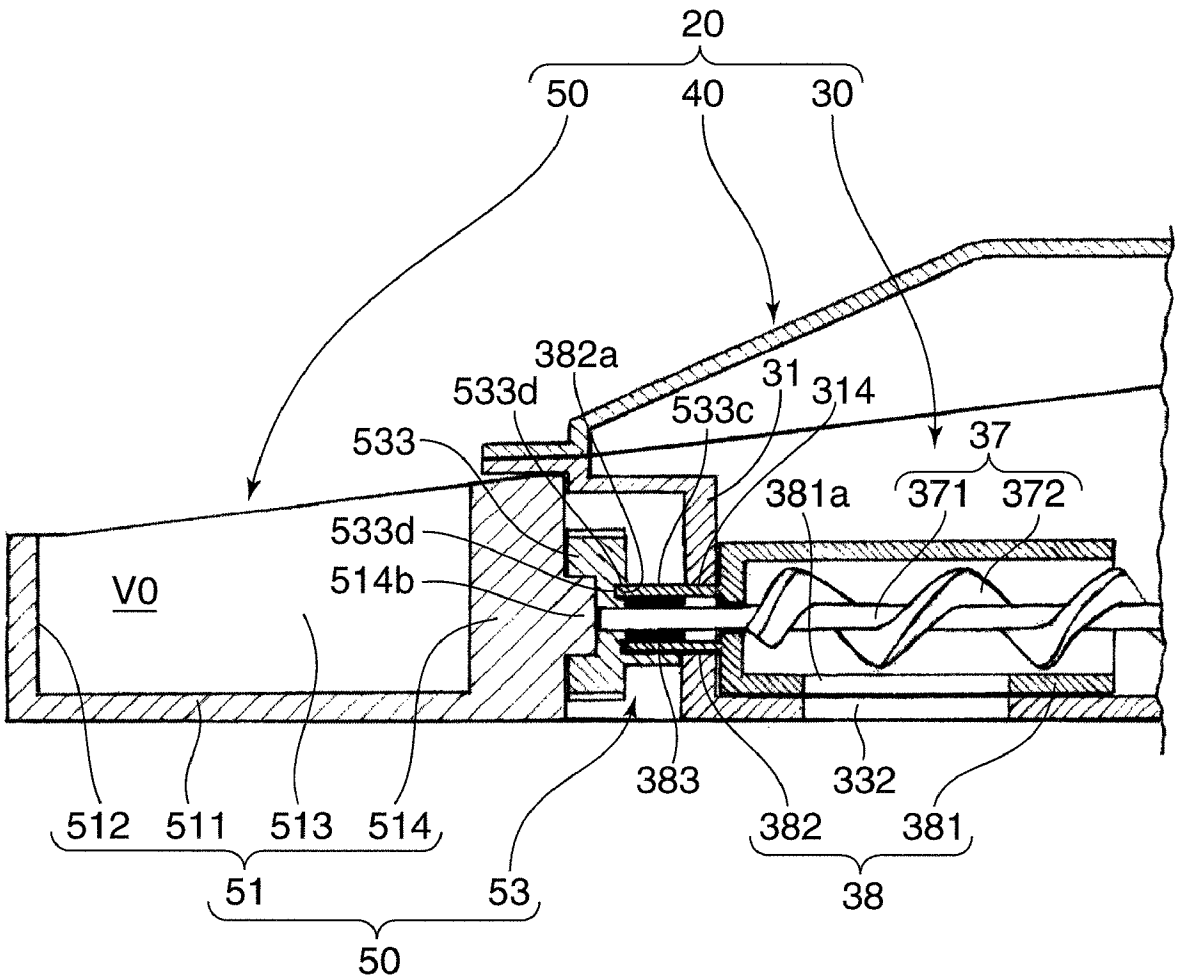
FIG. 6 is a sectional view along VI-VI of FIG. 5.

The toner cartridge 20 (developer cartridge) is described below. FIG. 4 is an exploded perspective view showing one embodiment of the toner cartridge 20. FIG. 5 is a perspective view of the assembled toner cartridge. FIG. 6 is a sectional view along VI-VI of FIG. 5. It should be noted that direction indication by X and Y in FIGS. 4 to 6 is as in FIG. 1 (−X: leftward, +X: rightward, −Y: forward, +Y: backward).

The toner cartridge 20 includes a cartridge main body 30 long in forward and backward directions and having an open upper surface, a lid 40 for closing an opening in the upper surface of this cartridge main body 30 and a front-end mounting member 50 to be mounted on the front end of the cartridge main body 30.

The cartridge main body 30 includes a front plate 31 extending in a direction orthogonal to sliding directions (mounting and detaching directions) of the toner cartridge 20, a rear plate 32 arranged to face this front plate 31 at the rear side, a bottom plate 33 extending between the lower edges of the front and rear plates 31 and 32, a left plate 34 extending upward from the left edge of the bottom plate 33 and a right plate 35 extending upward from the right edge of the bottom plate 33.

The bottom plate 33 is composed of a large arcuate bottom plate 33*a* on the right side having a large arcuate shape when viewed from the front end and a small arcuate bottom plate 33*b* having a small arcuate shape when viewed from the front end. In the cartridge main body 30, a partition portion 331 is disposed between the large and small arcuate bottom plates 33*a* and 33*b* to partition them.

A developer filling opening is formed in a part of the front plate 31 corresponding to the large arcuate bottom plate 33*a*. This developer filling opening is closed by a cap 313 after the developer is filled into the toner cartridge 20 with the lid 40 fixed to the cartridge main body 30. As shown in FIG. 6, the front plate 31 is formed with a through hole 314 perforated at the curvature center position of a small arcuate portion and adapted to permit the slidable insertion of an operable tube shaft 382 to be described later.

The lid 40 includes a horizontal top plate 41 in the form of a flat plate, an inclined top plate 42 extending obliquely downward toward the front from the front end of the horizontal top plate 41, a left plate 43 extending downward from the left edge of the horizontal top plate 41, a right plate 44 extending downward from the right edge of the horizontal top plate 41 and a rear plate 45 extending downward from the rear edge of the horizontal top plate 41.

An accommodating recess 411, which is U-shaped when viewed from above, is formed in the upper surface of the lid 40. A handle 412 rotatable in forward and reverse directions about a specified shaft is so accommodated in the accommodating recess 411 as to be able to project and retract.

A lid side flange 46 projecting outwardly over the entire circumference is provided on the lower edge of the lid 40. On the other hand, a main-body side flange 39 corresponding to the lid side flange 46 is provided on the upper edge of the cartridge main body 30. The opening in the upper surface of the cartridge main body 30 is closed by the lid 40 as shown in FIG. 5 by performing a fusing process, e.g. by applying high-frequency waves to the lid side flange 46 and the main-body side flange 39 with the flange 46 placed on the flange 39.

An agitator 36 for agitating the developer is provided in a space above the large arcuate bottom plate 33*a* in the cartridge main body 30. The agitator 36 includes an agitating shaft 361 extending in forward and backward directions and a plurality of (four in an example shown in FIG. 4) of film-made agitating fins 362 projecting radially outward at equal intervals in a circumferential direction from the circumferential surface of this agitating shaft 361.

The agitating shaft 361 is so mounted as to be located at the curvature center position of the large arcuate bottom plate 33*a* between the front plate 31 and the rear plate 32. A projecting distance of the respective agitating fins 362 from the agitating shaft 361 is set to be slightly longer than the radius of curvature of the large arcuate bottom plate 33*a*. Accordingly, when the agitating fins 362 integrally rotate about the agitating shaft 361, the leading end edges of the agitating fins 362 slide on the arcuate bottom plate 33, whereby the developer is reliably agitated.

A screw feeder (conveying member) 37 extending in forward and backward directions and a tubular shutter member 38 fitted on the screw feeder 37 at a front end position for opening and closing a developer supply port 332 are provided in a space above the small arcuate bottom plate 33*b* in the cartridge main body 30.

The screw feeder 37 includes a feeder shaft 371 extending in forward and backward directions in the space above the small arcuate bottom plate 33*b* and a spiral fin 372 coaxial with the circumferential surface of this feeder shaft 371. The feeder shaft 371 is so mounted between the front plate 31 and the rear plate 32 as to be located at the curvature center position of the small arcuate bottom plate 33*b*.

The spiral fin 372 is set such that a radial dimension (radius) is slightly smaller than the radius of curvature of the small arcuate bottom plate 33*b* when viewed in −Y direction from the front. The spiral fin 372 is a left-hand spiral. Here, the left-hand spiral is a spiral formed to extend in a counterclockwise direction in a direction away from a viewer viewing an end surface of the screw feeder 37. Accordingly, when the spiral fin 372 rotates in a counterclockwise direction about the feeder shaft 371 when viewed from the front end, the developer is conveyed toward the developer supply port 332 at the front side.

An unillustrated gear mechanism for interlocking the agitating shaft 361 and the feeder shaft 371 by a plurality of gears is provided on the back side (rear side) of the rear plate 32. By transmitting a drive force of an unillustrated drive motor to this gear mechanism, the agitating shaft 361 and the feeder shaft 371 simultaneously rotate about their axes.

As shown in a circle of FIG. 4, the shutter member 38 includes a cylindrical shutter tube 381, the outer radial dimension (radius) of which is set to be slightly smaller than the radius of curvature of the small arcuate bottom plate 33*b* and the inner radial dimension of which is set to be slightly larger than the outer diameter of the spiral fin 372, and the operable tube shaft 382 concentrically projecting forward from the front side of the shutter tube 381. A shutter opening 381*a* is formed at a position of the circumferential surface of the shutter tube 381 corresponding to the developer supply port 332 (FIG. 6). The front end of the screw feeder 37 is accommodated in the shutter tube 381. The shutter tube 381 is rotatable about its center.

The shutter tube 381 is bottomed by having an opening in its front end surface closed by an end plate 381*b*. This prevents the developer having entered the shutter tube 381 through an opening in the rear surface of the shutter member 38 by the driving of the screw feeder 37 from coming out forward. The operable tube shaft 382 projects forward from the center position of the end plate 381*b*. A key projection 382*a* projecting forward is provided on the front end of the operable tube shaft 382. This key projection 382*a* is fitted into a key groove 533*d* (FIG. 6) of a second section gear 533 to be described later.

The feeder shaft 371 is passed through the operable tube shaft 382. An annular one-way clutch (interlocking mechanism) 383 (FIGS. 6 and 7) is interposed between the operable tube shaft 382 and the feeder shaft 371. The one-way clutch 383 fulfills a function of transmitting the rotation of the operable tube shaft 382 to the feeder shaft 371 when the operable tube shaft 382 rotates in the counterclockwise direction about its axial center when viewed from front while not transmitting it to the feeder shaft 371 when the operable tube shaft 382 rotates in a clockwise direction about its axial center.

This indicates that the feeder shaft 371 rotates in the counterclockwise direction about its axial center without being restricted by the one-way clutch 383 when viewed from the front end side, thereby conveying the developer forward. In short, the feeder shaft 371 does not rotate in the clockwise direction about its axial center when viewed from the front end side.

Figure 7A:
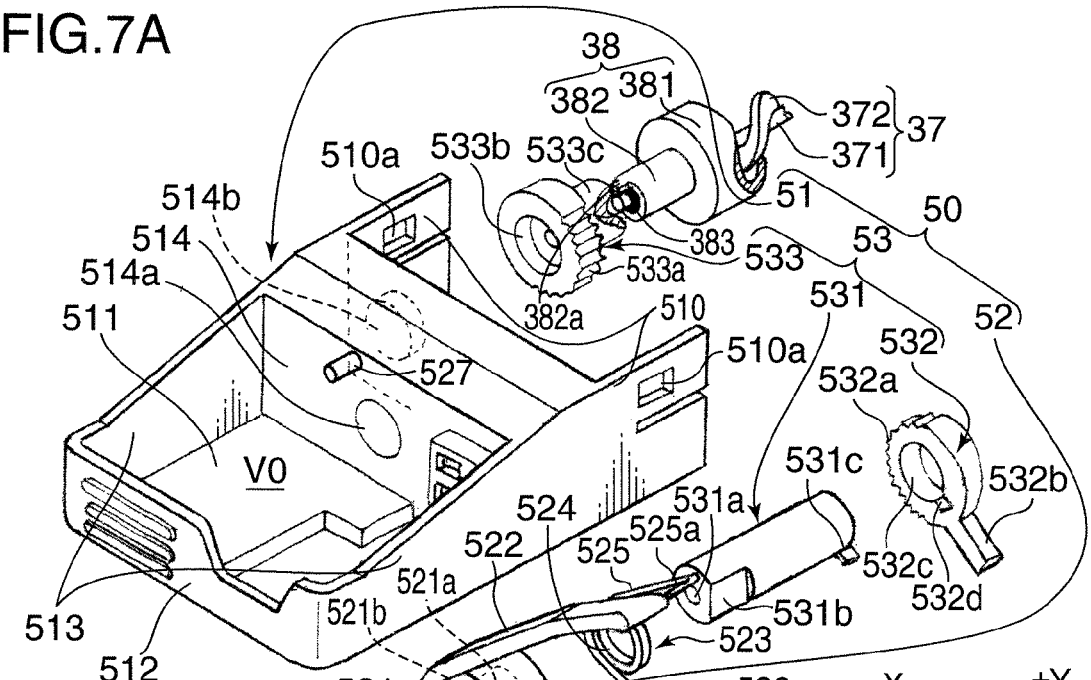
FIG. 7A is an exploded perspective view of a front-end mounting member.
Figure 7B:
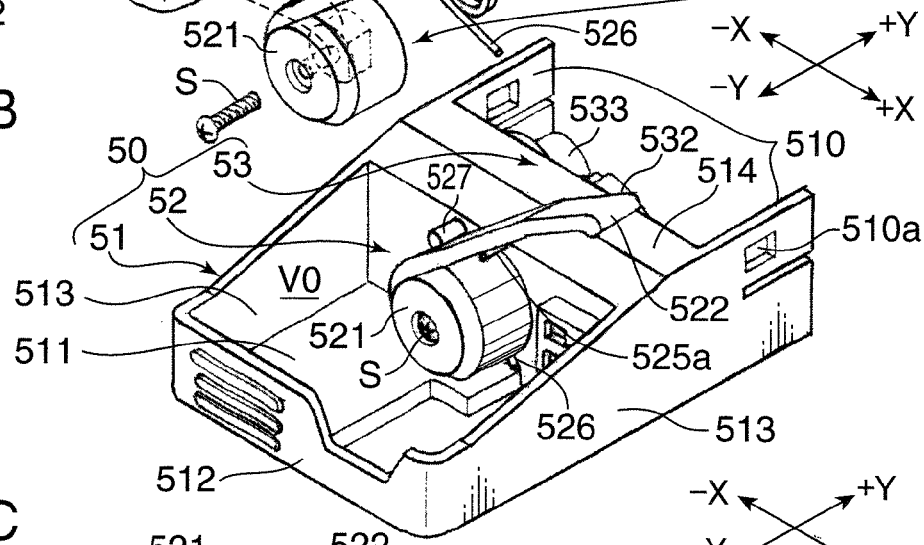
FIG. 7B is an exploded perspective view of the front-end mounting member when viewed from front.
Figure 7C:
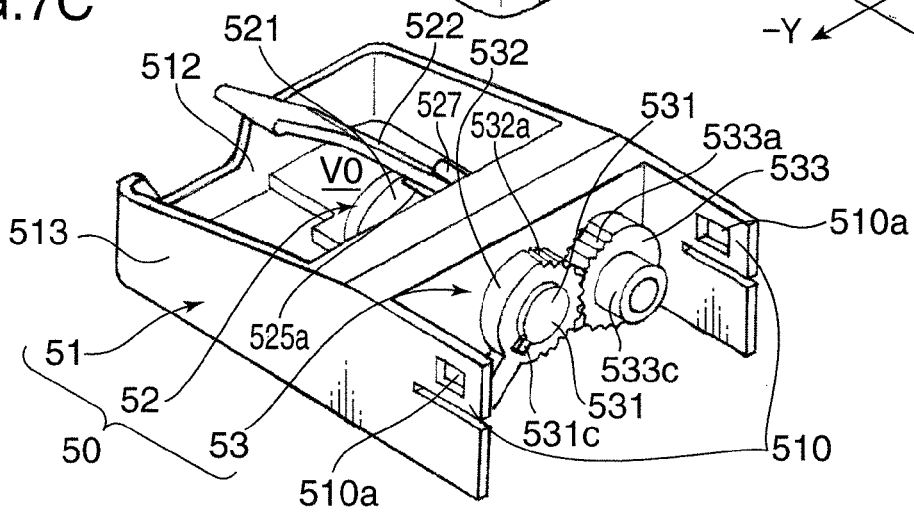
FIG. 7C is an assembled perspective view of the front-end mounting member when viewed from behind.

With reference to FIGS. 7A to 7C and, if necessary, other figures, the front-end mounting member 50 is described below. FIG. 7A is an exploded perspective view of the front-end mounting member 50, FIG. 7B is an assembled perspective view of the front-end mounting member 50 when view from the front side, and FIG. 7C is an assembled perspective view of the front-end mounting member 50 when viewed from the back side (rear side). It should be noted that direction indication by X and Y in FIGS. 7A to 7C is as in FIG. 1 (−X: leftward, +X: rightward, −Y: forward, +Y: backward).

The front-end mounting member 50 is mounted on the front end surface of the cartridge main body 30 for receiving specified operations on the toner cartridge 20 from a user, specifically mounting and detaching operations of the toner cartridge 20 into and from the apparatus main body 11 and opening and closing operations of the shutter member 38.

The front-end mounting member 50 includes an end surface cover 51 which covers the front end surface of the cartridge main body 30 and functions as a grip upon mounting and detaching the toner cartridge 20 into and from the apparatus main body 11, the operation lever 52 for opening and closing the shutter member 38 and a transmitting mechanism 53 (part of the interlocking mechanism) for translating the operation of this operation lever 52 into the opening or closing operation of the shutter member 38.

The end surface cover 51 includes a base plate portion 514 to be engaged with the front plate 31 of the cartridge main body 30 while rotatably holding the operation lever 52, a front plate 512 distant from the base plate portion 514 in the sliding direction of the toner cartridge 20 and arranged to face the base plate portion 514, and a bottom plate 511 for connecting bottom parts of the base plate portion 514 and the front plate 512. The front plate 512 is arranged to face the base plate portion 514 while a space permitting fingers to be inserted from a space above is defined between the front plate 512 and the operation lever 52. A pair of left and right plates 513 arranged at the opposite sides of the operation lever 52 are provided between the base plate portion 514 and the front plate 512.

A grip portion is formed by the bottom plate 511, the front plate 512, the left and right plates 513 and the base plate portion 514. In other words, a finger insertion space V0 permitting an operator to insert his or her fingers thereinto from above to mount and detach the toner cartridge 20 is formed by these members. By forming the finger insertion space V0, the user can easily mount and detach the toner cartridge 20 into and from the apparatus main body 11.

The base plate portion 514 is mounted on the front plate 31 of the cartridge main body 30 with the operation lever 52 rotatably held. For this mounting, the base plate portion 514 includes a pair of tightly holding end portions 510 projecting backward from the left and right ends. By tightly holding the front end portion of the cartridge main body 30 by this pair of tightly holding end portions 510, the end surface cover 51 is stably mounted on the cartridge main body 30.

Each tightly holding end portion 510 is formed with a rectangular locking hole 510*a*. On the other hand, locking projections 341, 351 (FIG. 4) project at positions of the left and right plates 34 and 35 of the cartridge main body 30 corresponding to the rectangular locking holes 510*a*. Accordingly, as the cartridge main body 30 is tightly held by the pair of tightly holding end portions 510 from front, the respective rectangular locking holes 510*a* are engaged with the corresponding locking projections 341, 351 after the pair of tightly holding end portions 510 are elastically deformed in directions away from each other. In this way, the end surface cover 51 is mounted on the front end portion of the cartridge main body 30.

A mount hole 514*a* used to mount the operation lever 52 on the end surface cover 51 via a rotary shaft body 531 with the operation lever 52 penetrating through the rotary shaft body 531 is formed at a substantially center position of the base plate portion 514 in the lateral direction. Further, a cylindrical body 514*b*, on which the second section gear 533 to be described later is to be mounted, projects backward at a left position on the rear surface of the base plate portion 514.

The operation lever 52 includes a hollow cylindrical body 521 (base portion) which rotates about its axial center, a lever plate 522 projecting in a tangential direction toward a clockwise side from the circumferential surface of this hollow cylindrical body 521 and a torsion spring (biasing member) 523 for giving a biasing force to this lever plate 522.

The hollow cylindrical body 521 is formed in its rear end surface with a D-hole 521*a* concentric with the hollow cylindrical body 521 and D-shaped when viewed in forward and backward directions. A partition wall is provided on the bottom of the D-hole 521*a*, and a through hole 521*b* is concentrically formed in this partition wall. The through hole 521*b* is for permitting the passage of a screw S when the hollow cylindrical body 521 is fixed to the rotary shaft body 531.

Such an operation lever 52 is displaceable between an inclined posture (closing posture) where the lever plate 522 extends obliquely upward toward the right and a laid posture (opening posture) where the lever plate 522 extends horizontally to the right. In this embodiment, an angle of inclination of this lever plate 522 with respect to a horizontal plane in a state where the lever plate 522 is set in the inclined posture is set to be about 45°.

The torsion spring 523 is composed of an annular twisted part 524, an upwardly extending part 525 extending upward to the right from one end of the twisted part 524 and a downwardly extending part 526 extending downward to the right from the other end of the twisted part 524. The inner diameter of the twisted part 524 is set to be slightly larger than the outer diameter of the rotary shaft body 531 to be described later, whereby the twisted part 524 can be fitted on the rotary shaft body 531 to be united with the lever plate 522 via the operation lever 521. In a state where no load acts on the torsion spring 523, an angle formed between the upwardly extending part 525 and the downwardly extending part 526 is set to be slightly larger than 45°.

The tip of the upwardly extending part 525 is bent forward, and a lever receiving portion 525*a* for receiving the operation lever 52 is formed by this bent part. Accordingly, the downwardly extending part 526 is located on the bottom plate 511 and the lever receiving portion 525*a* of the upwardly extending part 525 supports the lever plate 522 as shown in FIG. 7B in a state where the operation lever 52 is mounted on the base plate portion 514 of the end surface cover 51 via the rotary shaft body 531 and the torsion spring 523 fitted on this rotary shaft body 531.

In order to set the angle of inclination of the lever plate 522 with respect to the horizontal plate at about 45°, a stopper pin 527 extending in forward and backward directions is fixed at a position above the operation lever 52 on the front surface of the base plate portion 514. The lever plate 522 is pressed against the stopper pin 527 by a biasing force of the torsion spring 523 in a state where the maintenance door 19 is opened, i.e. in a state where the lever plate 522 is not pressed by the pressing rod 190. In this way, the operation lever 52 is kept in the inclined posture.

On the other hand, the pressing rod 190 (FIG. 2) projecting at the rear side of the maintenance door 19 is so provided as to correspond to the lever plate 522 set in the inclined posture. An inclined surface 190*a* inclined obliquely upward from the lower surface to the upper surface in an extending direction of the pressing rod 190 (projecting direction from the maintenance door 19) is formed on the tip of the pressing rod 190. The pressing rod 190 is set at such a position where an upper position of the inclined surface 190*a* first comes into contact with an upper surface part of the lever plate 522 when the maintenance door 19 is closed. Further, the thickness of the pressing rod 190 in a vertical direction is so set that the bottom end of the inclined surface 190*a* is not disengaged from the lever plate 522 with the maintenance door 19 closed.

Accordingly, an upper end part of the inclined surface 190*a* of the pressing rod 190 comes into contact with the front edge of the lever plate 522 set in the inclined posture as the opened maintenance door 19 is closed. If the maintenance door 19 continues to be closed in this state, the inclined surface 190*a* presses the lever plate 522 downward by a downwardly acting component of force created by the sliding contact of the inclined surface 190*a* with the lever plate 522. Thus, the lever plate 522 will move toward the laid posture against the biasing force of the torsion spring 523.

Conversely, when the closed maintenance door 19 is opened, the lever plate 522 is freed from the pressed state by the pressing rod 190. Thus, the lever plate 522 rotates in a counterclockwise direction about the rotary shaft body 531 by the biasing force of the torsion spring 523. This rotational force is transmitted to the shutter member 38 by the transmitting mechanism 53 to be described later and the developer supply port 332 is closed by the shutter tube 381.

The transmitting mechanism 53 causes the shutter member 38 and the screw feeder 37 to operate as the operation lever 52 is displaced to change the posture (rotation of the hollow cylindrical body 521). The transmitting mechanism 53 includes the rotary shaft body 531 extending in forward and backward directions, a first section gear 532 fitted on this rotary shaft body 531 and the second section gear 533 engaged with the first section gear 532.

The rotary shaft body 531 is so inserted into the mount hole 514*a* as to be rotatable about its axial center while being held in sliding contact with the mount hole 514*a*. The length of the rotary shaft body 531 is set to be slightly larger than the thickness of the base plate portion 514 of the end surface cover 51 in forward and backward directions. Thus, the front and rear ends of the rotary shaft body 531 project slightly outward with the rotary shaft body 531 inserted in the mount hole 514*a* of the base plate portion 514.

With the rotary shaft body 531 inserted in the mount hole 514*a*, the hollow cylindrical body 521 of the operation lever 52 is so fitted on the front end of the rotary shaft body 531 as to be integrally rotatable, and the first section gear 532 is fitted on the rear end thereof. The second section gear 533 is engaged with the first section gear 532 while being supported rotatably about the axis of the cylindrical body 514*b*.

An internally threaded hole 531*a*, into which a screw S is to be screwed, is concentrically formed in the front end surface of the rotary shaft body 531. Further, a D-cut surface 531*b* corresponding to the D-hole 521*a* is formed in the circumferential surface of the front end side of the rotary shaft body 531. Upon assembling the operation lever 52 and the transmitting mechanism 53, the twisted part 524 of the torsion spring 523 is first fitted on the front end of the rotary shaft body 531 and, then, the front end of the rotary shaft body 531 is fitted into the D-hole 521*a* of the hollow cylindrical body 521. In this state, the screw S is screwed into the internally threaded hole 531*a* of the rotary shaft body 531 via the through hole 521*b* of the hollow cylindrical body 521. As a result, the operation lever 52 is so mounted on the rotary shaft body 531 as to be integrally rotatable about the axial center.

A key piece 531*c* projecting radially outward from the circumferential surface is provided on the rear end of the rotary shaft body 531. This key piece 531*c* is for enabling the first section gear 532 to rotate together with the rotary shaft body 531 about the axial center. As the rotary shaft body 531 is inserted into the mount hole 514*a* from behind, the key piece 531*c* interferes with an edge part of the mount hole 514*a*, whereby the rotary shaft body 531 is not inserted into the mount hole 514*a* any further. In this way, the inserted position of the rotary shaft body 531 in the mount hole 514*a* can be set.

The first section gear 532 includes gear teeth 532*a* on the left circumferential surface and a stopper piece 532*b* (stopper) provided on a part of the circumferential surface facing the gear teeth 532*a* (right circumferential surface in a state shown in FIG. 7A) and projecting radially outward. A center hole 532*c* whose inner diameter is slightly larger than the outer diameter of the rotary shaft body 531 is formed at the center position of the first section gear 532. The center hole 532*c* is recessed to form a key recess 532*d* corresponding to the key piece 531*c*.

The first section gear 532 is so supported on the rotary shaft body 531 as to be integrally rotatable about the axial center by engaging the center hole 532*c* with the rotary shaft body 531 in such a manner that the key piece 531*c* is fitted into the key recess 532*d*. The first section gear 532 is so positioned that the gear teeth 532*a* face leftward and the stopper piece 532*b* faces rightward with the operation lever 52 set in the inclined posture.

The second section gear 533 is rotatably fitted on the cylindrical body 514*b* projecting from the rear surface of the base plate portion 514 of the end surface cover 51. The second section gear 533 displaces the shutter member 38 between the opening position and the closing position by rotating the shutter member 38 in forward and reverse directions. Gear teeth 533*a* engaged with the gear teeth 532*a* of the first section gear 532 are formed on the right side of the circumferential surface of the second section gear 533. Further, a bottomed engaging hole 533*b* to be slidably engaged with the cylindrical body 514*b* is concentrically formed in the front surface of the second section gear 533.

A coupling tube 533*c* projects from the rear surface of the second section gear 533. The inner diameter of this coupling tube 533*c* is set to be slightly larger than the outer diameter of the operable tube shaft 382 of the shutter member 38. The coupling tube 533*c* is fitted on the operable tube shaft 382 by mounting the end surface cover 51 on the front end of the cartridge main body 30. The coupling tube 533*c* is formed at its rear end with the key groove 533*d* (FIG. 6) into which the key projection 382*a* is to be fitted.

By mounting the end surface cover 51 on the front end portion of the cartridge main body 30, the key groove 533*d* of the second section gear 533 is engaged with the key projection 382*a* of the operable tube shaft 382 of the shutter member 38. When the second section gear 533 rotates, this rotation is transmitted to the shutter tube 381 via the key groove 533*d* and the key projection 382*a*. Thus, the shutter tube 381 can be displaced between the opening position and the closing position.

Figure 8B:
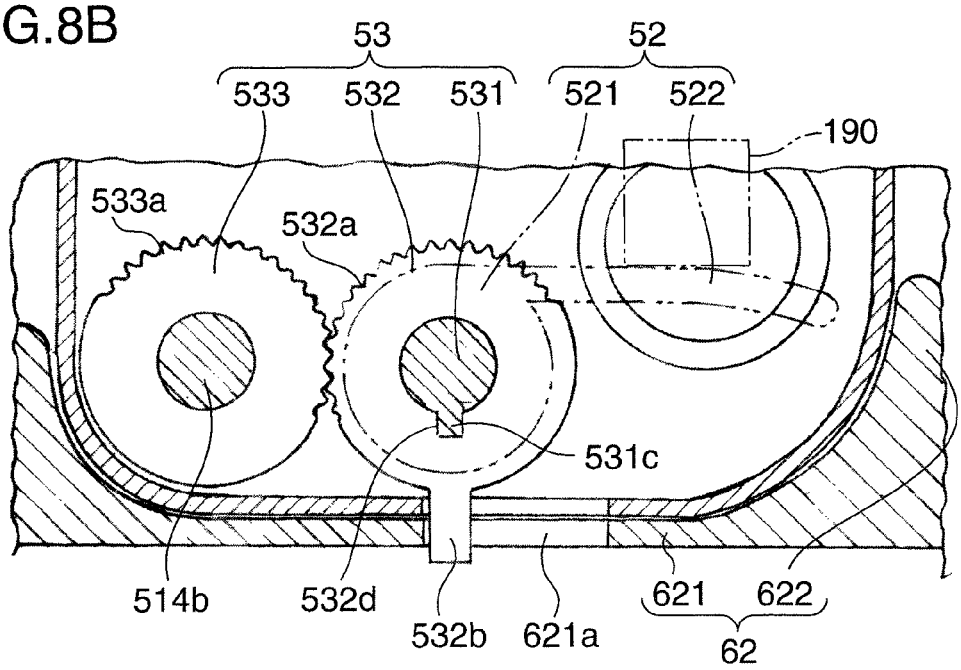
FIG. 8B is a schematic sectional view along VIIIB-VIIIB of FIG. 8A.

FIG. 8A is a perspective view showing a state where the toner cartridge 20 is supported on the toner junction/storage device 60 and FIG. 8B is a schematic sectional view along VIIIB-VIIIB of FIG. 8A. It should be noted that direction indication by X and Y in FIGS. 8A and 8B is as in FIG. 1 (−X: leftward, +X: rightward, −Y: forward, +Y: backward).

As shown in FIG. 8A, the toner junction/storage device 60 includes a rectangular parallelepipedic device main body 61 and a supporting member 62 provided on the top of the device main body 61 for supporting the front ends of the respective toner cartridges 20.

Unillustrated junction ducts, collection ducts and waste toner containers are provided in the device main body 61. A plurality of junction ducts are provided to supply the developers from the respective toner cartridges 20 to the corresponding developing devices 122. The collection ducts are for conveying the waste toner removed from the photoconductive drums 121 and the intermediate transfer belt 125 by the respective drum cleaners 127 and the belt cleaner 128. The waste toner container stores the waste toners conveyed by the collection ducts.

The supporting member 62 includes a supporting plate 621 whose lateral dimension is set to be substantially equal to those of the four toner cartridges 20 arranged side by side, a plurality of partition plates 622 (five in an example shown in FIG. 8A) standing on the supporting plate 621 and shutter mechanisms 623 formed between the adjacent partition plates 622 on the supporting plate 621. Support spaces V1, into which the front end portions of the toner cartridge 20 are inserted, are formed between the adjacent partition plates 622.

Each shutter mechanism 623 includes an unillustrated shutter plate. This shutter plate is pressed when the toner cartridge 20 is slid and pushed into the support space V1, thereby being opened against a biasing force of an unillustrated biasing member. On the other hand, the shutter plate is closed by the biasing force of the biasing member when the toner cartridge 20 is pulled out forward from the support space V1.

A lock hole 621*a* as shown in FIG. 8B is formed in the supporting plate 621 for each support space V1. This lock hole 621*a* is formed at a position corresponding to the stopper piece 532*b* of the lever plate 522 set in the laid posture.

When the toner cartridges 20 are pushed into the lower main body 111 and the maintenance door 19 is closed with the front ends of the toner cartridges 20 supported in the support spaces V1 on the supporting plate 621, the inclined surfaces 190*a* of the pressing rods 190 provided on the maintenance door 19 press the lever plates 522 downward. This causes the lever plates 522 set in the inclined postures to rotate in the clockwise direction about the rotary shaft bodies 531 against the biasing forces of the torsion springs 523 and to be set in the laid postures. This causes the stopper pieces 532*b* to be fitted into the lock holes 621*a* as shown in FIG. 8B, whereby the toner cartridges 20 are locked in the mounted state in the lower main body 111.

This locked state is canceled by opening the maintenance door 19. In other words, when the maintenance door 19 is opened, the operation levers 52 are released from the pressed states by the pressing rods 190. Accordingly, the operation levers 52 are rotated in the counterclockwise direction about the rotary shaft bodies 531 by the biasing forces of the torsion springs 523 and the stopper pieces 532*b* come out of the lock holes 621*a* to cancel the locked state. In this state, the toner cartridges 20 can be pulled out from the support spaces V1.

The functions of the transmitting mechanism 53 and the shutter member 38 are described with reference to FIGS. 9A to 9D and, if necessary other figures, and the function of the pressing rod 190 is described with reference to FIGS. 10A and 10B.

Figures 9A, 9B, 9C, 9D:
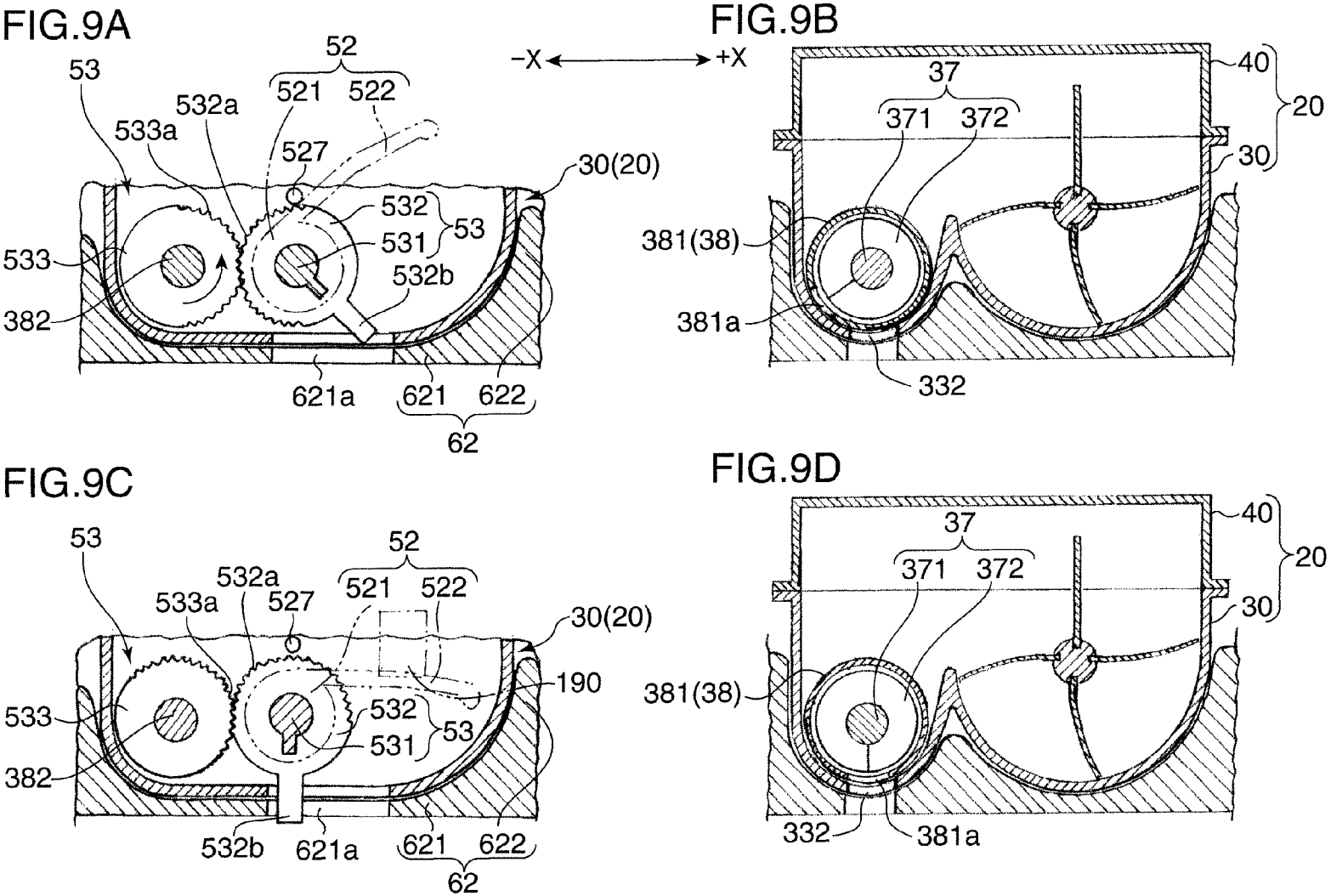

FIGS. 9A to 9D are diagrams showing the function of the transmitting mechanism 53, wherein FIGS. 9A and 9B show states of the transmitting mechanism 53 and the shutter member 38 when the lever plate 522 is set in the inclined posture and FIGS. 9C and 9D show states of the transmitting mechanism 53 and the shutter member 38 when the lever plate 522 is set in the laid posture. FIGS. 9A and 9C show the states of the transmitting mechanism 53 and FIGS. 9B and 9D show the states of the shutter member 38. It should be noted that direction indication by X and Y in FIGS. 9A to 9D is as in FIG. 1 (−X: leftward, +X: rightward, −Y: forward, +Y: backward).

Figure 10A:
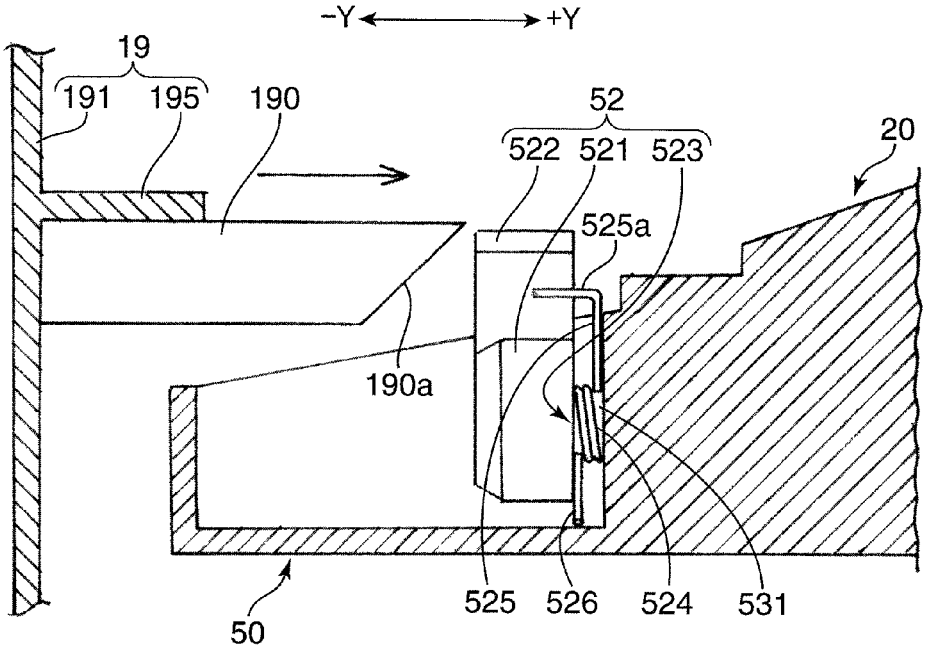
Figure 10B:
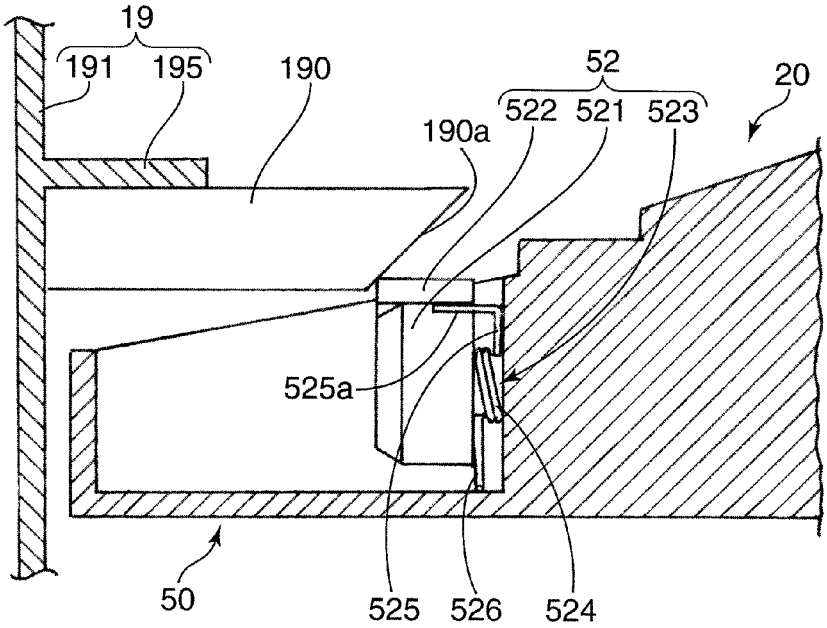

FIGS. 10A and 10B are side views partly in section showing the function of the pressing rod 190, wherein FIG. 10A shows a state immediately before the maintenance door 19 is closed and FIG. 10B shows a state where the maintenance door 19 is closed.

First of all, immediately after the toner cartridge 20 is mounted in the support space V1 on the supporting plate 621, the lever plate 522 of the operation lever 52 is set in the inclined posture by the biasing force of the torsion spring 523 (FIG. 7A) as shown in FIG. 9A. Accordingly, the stopper piece 532*b* provided on the first section gear 532 is out of the lock hole 621*a* of the supporting plate 621 to extend obliquely downward toward the right.

In this state, the shutter tube 381 of the shutter member 38 is set such that the shutter opening 381*a* is located at the closing position where it faces obliquely downward to the left by being displaced from the developer supply port 332 as shown in FIG. 9B. Accordingly, the developer supply port 332 formed in the bottom plate 33 of the cartridge main body 30 is closed and the developer is not supplied to the developing device 122 through the developer supply port 332.

Subsequently, as the maintenance door 19 is closed, an upper side of the inclined surface 190*a* of the pressing rod 190 first faces the upper side of the lever plate 522 of the operation lever 52 as shown in FIG. 10A. If the maintenance door 19 continues to be closed in this state, the upper position of the inclined surface 190*a* of the pressing rod 190 interferes with the lever plate 522 to press the lever plate 522.

When being pressed by the inclined surface 190*a*, the lever plate 522 rotates by about 45° about the rotary shaft body 531 in the clockwise direction when viewed from front against the biasing force of the torsion spring 523 by a downward acting component of force created by the inclined surface 190*a*. A positional relationship between the pressing rod 190 and the lever plate 522 at this time is as shown in FIG. 10B. The rotation of the lever plate 522 is transmitted to the rotary shaft body 531 via the hollow cylindrical body 521 to rotate the rotary shaft body 531. By this rotation of the rotary shaft body 531, the stopper piece 532*b* provided on the second section gear 533 comes to extend downward and enter the lock hole 621*a* of the supporting plate 621, whereby the toner cartridge 20 is locked (FIG. 9C).

At this time, the shutter tube 381 integral to the operable tube shaft 382 also rotates only by about 45° by the rotation of the operable tube shaft 382 engaged with the first section gear 532. This causes the shutter opening 381*a* of the shutter tube 381 to face the developer supply port 332 as shown in FIG. 9D. In this way, the developer in the toner cartridge 20 is supplied into the developing device 122 via the shutter opening 381*a* and the developer supply port 332 by the rotation of the screw feeder 37.

The screw feeder 37 conveys the developer as the lever plate 522 is displaced from the inclined posture to the laid posture. Specifically, a clockwise rotational force of about 45° of the lever plate 522 (hollow cylindrical body 521) is transmitted to the feeder shaft 371 of the screw feeder 37 via the second section gear 533 and the one-way clutch 383. This rotating direction is a direction in which the feeder shaft 371 is rotated counterclockwise, i.e. a direction in which the developer can be conveyed to the developer supply port 332. Since the screw feeder 37 conveys the developer to the developer supply port 332 only by an amount corresponding to a rotation amount of the operation lever 52 in this way upon displacing the shutter member 38 from the closing position to the opening position, the developer can be quickly supplied.

On the contrary, when the maintenance door 19 is opened, the lever plate 522 is released from the pressed state by the pressing rod 190, wherefore the operation lever 52 is rotated in the counterclockwise direction about the rotary shaft body 531 by the biasing force of the torsion spring 523 and returns to the inclined posture. By this, the stopper piece 532*b* comes out of the lock hole 621*a* and the second section gear 533 engaged with the first section gear 532 is rotated in the clockwise direction about the operable tube shaft 382, whereby the developer supply port 332 is automatically closed by the shutter tube 381. Thus, even if the toner cartridge 20 is pulled out of the apparatus main body 11, there is no such inconvenience that the developer leaks from the developer supply port 332.

The rotational force accompanying the displacement of the lever plate 522 from the laid posture to the inclined posture is not transmitted to the feeder shaft 371 by the one-way clutch 383. Accordingly, there is no likelihood that the screw feeder 37 conveys the developer in the reverse direction.

As described in detail above, the toner cartridge 20 according to this embodiment is for supplying the developer to the developing device 122 and is detachably mounted into the apparatus main body 11 with the maintenance door 19 provided on the apparatus main body 11 of the image forming apparatus 10 opened.

The toner cartridge 20 includes the box-shaped cartridge main body 30 with the developer supply port 332 for supplying the developer to the developing device 122, the shutter member 38 for opening and closing the developer supply port 332, the operation lever 52 arranged to face the maintenance door 19 so as to be displaceable between the laid posture (opening posture) and the inclined posture (closing posture) to displace the shutter member 38 between the opening position where the developer supply port 332 is opened and the closing position where the developer supply port 332 is closed, and the torsion spring 523 for biasing this operation lever 52 toward the inclined posture.

The operation lever 52 is constantly biased toward the inclined posture by the biasing force of the torsion spring 523, whereby the shutter member 38 is located as the closing position for closing the developer supply port 332. In other words, when the operation lever 52 is in the inclined posture where it does not interfere with the pressing rod 190 of the maintenance door 19, the shutter member 38 is accordingly set at the closing position to close the developer supply port 332. Thus, at the time of replacing the toner cartridge 20 with a new one by opening the maintenance door 19, the developer in the toner cartridge 20 does not leak to the outside via the developer supply port 332.

When the toner cartridge 20 is mounted into the apparatus main body 11 of the image forming apparatus 10 with the maintenance door 19 opened and then the maintenance door 19 is closed, the pressing rod 190 of the maintenance door 19 interferes with the lever plate 522 of the operation lever 52. This causes the operation lever 52 to be displaced from the inclined posture to the laid posture and the shutter member 38 is set at the opening position to open the developer supply port 332. Further, locking by the stopper piece 532*b* is also realized. Thus, it can be prevented that the toner cartridge 20 is mounted with the developer supply port 332 left closed because it was forgotten to operate the operation lever 52. In addition, since the developer supply port 332 is opened and closed as the maintenance door 19 is closed and opened, it is not particularly necessary to detect the operational state of the operation lever 52 using a sensor, which can contribute to a reduction in the apparatus cost.

In this embodiment, the inclined surface 190*a* of the pressing rod 190 presses the lever plate 522 when the maintenance door 19 is closed. Thus, a structure for changing the posture of the operation lever 52 can be made easy and inexpensive.

In this embodiment, the cartridge main body 30 includes the screw feeder 37 for conveying the developer inside toward the developer supply port 332 and the interlocking mechanism is provided to cause the screw feeder 37 to convey the developer as the operation lever 52 is displaced from the inclined posture to the laid posture. Thus, when the screw feeder 37 is driven thereafter, the developer can be quickly supplied to the developing device 122 from the very beginning of the drive.

Further, the one-way clutch 383 for transmitting the rotational force to the screw feeder 37 only when the operation lever 52 is displaced from the inclined posture to the laid posture is employed as the interlocking mechanism. Accordingly, although the structure is simple, the displacement operation can be transmitted to the screw feeder 37 only when the operation lever 52 is displaced from the inclined posture to the laid posture. On the other hand, the transmission of the posture change of the operation lever 52 to the screw feeder 37 can be prevented when the operation lever 52 is displaced from the laid posture to the inclined posture. With this arrangement, there is no likelihood of conveying the developer, which has already reached the developer supply port 332, in the reverse direction.

The present invention is not limited to the above embodiment and also includes the following contents.

(1) In the above embodiment, the copier is described as an example of the image forming apparatus 10 employing the toner cartridges 20. The image forming apparatus is not limited to the copier and may be a printer or a facsimile machine.

(2) In the above embodiment, the image forming apparatus for color printing employing the intermediate transfer belt 125 as an image bearing member in addition to the photoconductive drums 121 is described as an example of the image forming apparatus 10. The image forming apparatus may be the one for color printing not including the intermediate transfer belt 125 or may be the one for black and white printing.

(3) In the above embodiment, the toner cartridges 20 are supported on the toner junction/storage device 60. The toner cartridges 20 may be supported on a specified frame provided in the apparatus main body 11 instead of on the toner junction/storage device 60.

(4) Although the operation of the operation lever 52 is transmitted to the screw feeder 37 in the above embodiment, the operation lever 52 and the screw feeder 37 may not be interlocked.

(5) In the above embodiment, the toner cartridge 20 may include a function as the developing device 122. In this case, the developing devices 122 need not be provided in the apparatus main body 11 and the number of parts of the image forming apparatus 10 can be reduced by that much.

The above specific embodiment mainly includes inventions having the following constructions.

A developer cartridge according to one aspect of the present invention is the one to be detachably mounted into an apparatus main body of an image forming apparatus with an opening door of the apparatus main body opened and adapted to supply developer to the apparatus main body and includes a cartridge main body with a supply port for supplying the developer to the apparatus main body; a shutter member displaceable between an opening position for opening the supply port and a closing position for closing the supply port; an operation lever arranged to face the opening cover and adapted to displace the shutter member between the opening position and the closing position, the operation lever being displaceable between an opening posture corresponding to the opening position and a closing posture corresponding to the closing position; and a biasing member for biasing the operation lever toward the closing posture, wherein the operation lever is displaced from the closing posture to the opening posture against a biasing force of the biasing member due to interference with a part of the opening cover when the opening cover is closed.

According to this construction, the operation lever is constantly biased toward the closing posture by the biasing force of the biasing member, whereby the shutter member is located at the closing position for closing the supply port. Thus, when the opening cover is opened and the operation lever is at the closing posture, the shutter member is accordingly set at the closing position to close the supply port. Therefore, the leakage of the developer in the developer cartridge to the outside via the supply port is prevented at the time of replacing the developer cartridge with a new one by opening the opening cover.

On the other hand, the part of the opening cover interferes with the operation lever when the developer cartridge is mounted into the apparatus main body and the opening cover is closed. Since this causes the operation lever to be displaced from the closing posture to the opening posture, the shutter member opens the supply port. Thus, the supply port is opened without that a user particularly operates the operation lever.

In the above construction, it is preferable that the operation lever includes a base portion mechanically coupled to the shutter member and a lever plate projecting from the base portion; that the biasing member is a spring for giving a biasing force to the lever plate; and that the lever plate interferes with the part of the opening cover when the opening cover is closed. According to this construction, the operation lever can be easily displaced by the interference with the part of the opening cover.

In the above construction, it is preferable to further include a conveying member arranged in the cartridge main body for conveying the developer toward the supply port and an interlocking mechanism for causing the conveying member to convey the developer as the operation lever is displaced from the closing posture to the opening posture. According to this construction, the conveying member conveys the developer toward the supply port in advance as the operation lever is displaced from the closing posture to the opening posture. Thus, the quick supply of the developer after the exchange of the cartridge can be realized.

In the above construction, the interlocking mechanism preferably includes a one-way clutch for transmitting a drive force accompanying the posture change of the operation lever to the conveying member only when the operation lever is displaced from the closing posture to the opening posture. According to this construction, although the structure is simple, it is possible to transmit the posture changing operation to the conveying member when the operation lever is displaced from the closing posture to the opening posture while not performing an opposite operation when the operation lever is displaced from the opening posture to the closing posture.

In this case, it is preferable that the developer cartridge further includes a screw feeder arranged in the cartridge main body and adapted to convey the developer toward the supply port by rotating about its axis and an interlocking mechanism for causing the screw feeder to convey the developer as the operation lever is displaced from the closing posture to the opening posture; that the base portion of the operation lever is a hollow cylindrical body with a rotary shaft and rotates about the rotary shaft when the posture is changed; and that the interlocking mechanism rotates the screw feeder by transmitting a rotational force of the hollow cylindrical body to the screw feeder. According to this construction, it is possible to generate a rotational force as the posture of the operation lever is changed and efficiently rotate the screw feeder using this rotational force.

In the above construction, it is preferable that the shutter member includes a cylindrical shutter tube and an opening formed in the circumferential surface of the shutter tube; that the base portion of the operation lever is a hollow cylindrical body with a rotary shaft and rotates about the rotary shaft when the posture is changed; and that the developer cartridge further comprises an interlocking mechanism for transmitting a rotational force of the hollow cylindrical body to the shutter tube when the operation lever is displaced from the closing posture to the opening posture and rotating the shutter tube about its center so that the opening and the supply port face each other. According to this construction, it is possible to generate a rotational force as the posture of the operation lever is changed and operate the shutter tube using this rotational force.

In this case, it is preferable that the developer cartridge further includes a screw feeder arranged in the cartridge main body and adapted to convey the developer toward the supply port by rotating about its axis; and that the screw feeder has one end thereof accommodated in the shutter tube and is rotated by the rotation of the shutter tube when the posture is changed from the closing posture to the opening posture. According to this construction, the shutter tube and the screw feeder can be interlocked with the posture change of the operation lever and operability can be improved.

The screw feeder preferably includes a feeder shaft and a spiral fin formed around the feeder shaft and the developer cartridge further includes a one-way clutch interposed between the feeder shaft and the shutter tube and adapted to transmit only the rotational force of the shutter tube to the feeder shaft when the posture is changed from the closing posture to the opening posture. According to this construction, a construction for transmitting only the rotational force accompanying the posture change of the operation lever in one direction to the feeder shaft can be easily formed.

In the above construction, it is preferable that the developer cartridge further includes a stopper displaceable between a locking posture where it projects from an outer wall surface of the cartridge main body to lock the developer cartridge in the apparatus main body and a retracted posture where it is retracted into the outer wall surface; and that the interlocking mechanism transmits the rotational force of the hollow cylindrical body also to the stopper to realize posture changes between the locking posture and the retracted posture. According to this construction, the locking structure for locking the developer cartridge in the apparatus main body can also be interlocked with the posture change of the operation lever.

An image forming apparatus according to another aspect of the present invention includes an apparatus main body with an opening cover; an image bearing member accommodated in the apparatus main body and adapted to bear a developer image; and a developer cartridge to be detachably mounted into the apparatus main body and adapted to supply the developer, where the developer cartridge has the above construction. According to this construction, it is possible to provide an image forming apparatus with good operability in replacing a developer cartridge with a new one.

In the above construction, it is preferable that the opening cover includes a pressing member projecting in a direction toward the operation lever from the rear surface of the opening cover; and that the operation lever interferes with the pressing member when the opening cover is closed. According to this construction, when a user opens or closes the opening cover, the operation lever is substantially operated by the pressing member.

In this case, it is preferable that the operation lever includes a base portion mechanically coupled to the shutter member and a lever plate projecting from the base portion; that the biasing member is a spring for giving a biasing force to the lever plate; and that the lever plate interferes with the pressing member when the opening cover is closed. According to this construction, the opening cover and the operation lever can easily interfere with each other.

The pressing member preferably includes an inclined surface for displacing the operation lever from the closing posture to the opening posture by coming into sliding contact with the lever plate when the opening cover is closed. According to this construction, the operation lever can be displaced from the closing posture to the opening posture by bringing the inclined surface of the pressing member into sliding contact with the operation lever, whereby a smooth posture change can be realized.

This application is based on Japanese Patent application serial No. 2009-155281 filed in Japan Patent Office on Jun. 30, 2009, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A developer cartridge to be detachably mounted into an apparatus main body of an image forming apparatus with an opening door of the apparatus main body opened and adapted to supply developer to the apparatus main body, comprising:

a cartridge main body with a supply port for supplying the developer to the apparatus main body, a conveying member arranged in the cartridge main body for conveying the developer toward the supply port;

a shutter member displaceable between an opening position for opening the supply port and a closing position for closing the supply port;

an operation lever arranged to face the opening cover and adapted to displace the shutter member between the opening position and the closing position, the operation lever being displaceable between an opening posture corresponding to the opening position and a closing posture corresponding to the closing position;

an interlocking mechanism for causing the conveying member to convey the developer as the operation lever is displaced from the closing posture to the opening posture; and a biasing member for biasing the operation lever toward the closing posture, wherein the operation lever is displaced from the closing posture to the opening posture against a biasing force of the biasing member due to interference with a part of the opening cover when the opening cover is closed.

2. A developer cartridge according to claim 1, wherein:

the operation lever includes a base portion mechanically coupled to the shutter member and a lever plate projecting from the base portion;

the biasing member is a spring for giving a biasing force to the lever plate; and the lever plate interferes with the part of the opening cover when the opening cover is closed.

3. A developer cartridge according to claim 1, wherein the interlocking mechanism includes a one-way clutch for transmitting a drive force accompanying the posture change of the operation lever to the conveying member only when the operation lever is displaced from the closing posture to the opening posture.

4. A developer cartridge to be detachably mounted into an apparatus main body of an image forming apparatus with an opening door of the apparatus main body opened and adapted to supply developer to the apparatus main body, comprising:

a cartridge main body with a supply port for supplying the developer to the apparatus main body;

a screw feeder arranged in the cartridge main body and adapted to convey the developer toward the supply port by rotating about its axis;

a shutter member displaceable between an opening position for opening the supply port and a closing position for closing the supply port;

an operation lever arranged to face the opening cover and adapted to displace the shutter member between the opening position and the closing position, the operation lever being displaceable between an opening posture corresponding to the opening position and a closing posture corresponding to the closing position, the operation lever including a base portion mechanically coupled to the shutter member and a lever plate projecting from the base portion, the lever plate interfering with the part of the opening cover when the opening cover is closed;

a biasing spring for giving a biasing force to the lever plate and for biasing the operation lever toward the closing posture; and an interlocking mechanism for causing the screw feeder to convey the developer as the operation lever is displaced from the closing posture to the opening posture;

wherein:

the base portion of the operation lever is a hollow cylindrical body with a rotary shaft and rotates about the rotary shaft when the posture is changed; and the interlocking mechanism rotates the screw feeder by transmitting a rotational force of the hollow cylindrical body.

5. A developer cartridge to be detachably mounted into an apparatus main body of an image forming apparatus with an opening door of the apparatus main body opened and adapted to supply developer to the apparatus main body, comprising:

a cartridge main body with a supply port for supplying the developer to the apparatus main body;

a shutter member displaceable between an opening position for opening the supply port and a closing position for closing the supply port, the shutter member including a cylindrical shutter tube and an opening formed in the circumferential surface of the shutter tube;

an operation lever arranged to face the opening cover and adapted to displace the shutter member between the opening position and the closing position, the operation lever being displaceable between an opening posture corresponding to the opening position and a closing posture corresponding to the closing position, the operation lever including a base portion mechanically coupled to the shutter member and a lever plate projecting from the base portion, the lever plate interfering with the part of the opening cover when the opening cover is closed, the base portion of the operation lever is a hollow cylindrical body with a rotary shaft and rotates about the rotary shaft when the posture is changed;

a biasing spring for giving a biasing force to the lever plate and for biasing the operation lever toward the closing posture; and an interlocking mechanism for transmitting a rotational force of the hollow cylindrical body to the shutter tube when the operation lever is displaced from the closing posture to the opening posture and rotating the shutter tube about its center so that the opening and the supply port face each other.

6. A developer cartridge according to claim 5, further comprising a screw feeder arranged in the cartridge main body and adapted to convey the developer toward the supply port by rotating about its axis, wherein the screw feeder has one end thereof accommodated in the shutter tube and is rotated by the rotation of the shutter tube when the posture is changed from the closing posture to the opening posture.

7. A developer cartridge according to claim 6, wherein:

the screw feeder includes a feeder shaft and a spiral fin formed around the feeder shaft; and the developer cartridge further comprises a one-way clutch interposed between the feeder shaft and the shutter tube and adapted to transmit only the rotational force of the shutter tube to the feeder shaft when the posture is changed from the closing posture to the opening posture.

8. A developer cartridge according to claim 5, further comprising a stopper displaceable between a locking posture where it projects from an outer wall surface of the cartridge main body to lock the developer cartridge in the apparatus main body and a retracted posture where it is retracted into the outer wall surface, wherein the interlocking mechanism transmits the rotational force of the hollow cylindrical body also to the stopper to realize posture changes between the locking posture and the retracted posture.

9. An image forming apparatus, comprising:

an apparatus main body with an opening cover;

an image bearing member accommodated in the apparatus main body and adapted to bear a developer image; and a developer cartridge to be detachably mounted into the apparatus main body with the opening cover opened and adapted to supply the developer, wherein the developer cartridge includes:

a cartridge main body with a supply port for supplying the developer to the apparatus main body, a conveying member arranged in the cartridge main body for conveying the developer toward the supply port;

a shutter member displaceable between an opening position for opening the supply port and a closing position for closing the supply port;

an operation lever for displacing the shutter member between the opening position and the closing position, the operation lever being displaceable between an opening posture corresponding to the opening position and a closing posture corresponding to the closing position;

an interlocking mechanism for causing the conveying member to convey the developer as the operation lever is displaced from the closing posture to the opening posture; and a biasing member for biasing the operation lever toward the closing posture, wherein the operation lever is displaced from the closing posture to the opening posture against a biasing force of the biasing member due to interference with a part of the opening cover when the opening cover is closed.

10. An image forming apparatus according to claim 9, wherein:

the opening cover includes a pressing member projecting in a direction toward the operation lever from the rear surface of the opening cover; and the operation lever interferes with the pressing member when the opening cover is closed.

11. An image forming apparatus according to claim 10, wherein;

the operation lever includes a base portion mechanically coupled to the shutter member and a lever plate projecting from the base portion;

the biasing member is a spring for giving a biasing force to the lever plate; and the lever plate interferes with the pressing member when the opening cover is closed.

12. An image forming apparatus according to claim 11, wherein the pressing member includes an inclined surface for displacing the operation lever from the closing posture to the opening posture by coming into sliding contact with the lever plate when the opening cover is closed.

* * * * *